US009087494B2

(12) United States Patent
Oba et al.

(10) Patent No.: US 9,087,494 B2
(45) Date of Patent: Jul. 21, 2015

(54) MUSICAL INSTRUMENT EQUIPPED WITH A PEDAL, AND METHOD THEREFOR

(71) Applicant: YAMAHA CORPORATION, Hamamatsu-shi, Shizuoka-ken (JP)

(72) Inventors: Yasuhiko Oba, Hamamatsu (JP); Yuji Fujiwara, Hamamatsu (JP); Yoshiya Matsuo, Hamamatsu (JP)

(73) Assignee: YAMAHA CORPORATION (JP)

( * ) Notice: Subject to any disclaimer, the term of this patent is extended or adjusted under 35 U.S.C. 154(b) by 263 days.

(21) Appl. No.: 13/742,572

(22) Filed: Jan. 16, 2013

(65) Prior Publication Data

US 2013/0180377 A1 Jul. 18, 2013

(30) Foreign Application Priority Data

Jan. 18, 2012 (JP) ..... 2012-008404

(51) Int. Cl.

| | |
|---|---|
| ***G10H 1/32*** | (2006.01) |
| ***G10H 3/00*** | (2006.01) |
| ***G10C 3/26*** | (2006.01) |

(Continued)

(52) U.S. Cl.

CPC .. *G10C 3/26* (2013.01); *G10F 1/02* (2013.01); *G10G 3/04* (2013.01)

(58) Field of Classification Search

CPC ..... G06F 3/0219; G06F 3/0238; G10H 1/00; G10H 1/0066; G10H 1/346; G10H 1/32; G10H 2230/011; G10H 2240/056; G10H 7/00; G10H 3/12; G10H 1/045; G10H 2250/631; G10F 1/02; G10F 5/00; G10F 3/10; G10K 15/02; G10G 3/04; G10G 1/00; G10C 3/12; G10C 3/20

See application file for complete search history.

(56) References Cited

U.S. PATENT DOCUMENTS 5,131,306 A * 7/1992 Yamamoto ..... 84/19
5,247,129 A * 9/1993 Nozaki et al. ..... 84/615

(Continued)

FOREIGN PATENT DOCUMENTS

EP 1837853 A1 9/2007
JP 2993424 B2 12/1999

(Continued)

OTHER PUBLICATIONS

Korean Office Action cited in Korean counterpart application No. KR10-2013-5208, dated Mar. 4, 2014. English translation provided.

(Continued)

*Primary Examiner* — Marlon Fletcher

(74) *Attorney, Agent, or Firm* — Rossi, Kimms & McDowell LLP

(57) ABSTRACT

In a player piano, a position sensor is provided on an end portion of a lifting rail for detecting a vertical position of the lifting rail. In storing performance data of dampers, a signal output from the position sensor and indicative of a vertical position of the lifting rail is converted into a digital signal, and a position value indicative of the position of the lifting rail is generated on the basis of the digital signal and stored into a buffer. A conversion section converts the position value into a vertical position of a pedal rod connected to a damper pedal, and the thus-converted vertical position is converted, into a control value which a control change message of the damper pedal in MIDI-format data can take. The control value obtained in the aforementioned manner can be recorded into a recording medium as performance information.

12 Claims, 11 Drawing Sheets

(51) Int. Cl.
*G10F 1/02* (2006.01)
*G10G 3/04* (2006.01)

(56) References Cited

U.S. PATENT DOCUMENTS

| | | | | |
|---|---|---|---|---|
| 5,714,702 | A * | 2/1998 | Ishii | 84/462 |
| 7,851,690 | B1 * | 12/2010 | Stahnke | 84/723 |
| 2005/0235808 | A1 * | 10/2005 | Ishii et al. | 84/600 |
| 2006/0156905 | A1 | 7/2006 | Sant | |
| 2009/0235803 | A1 * | 9/2009 | Iwamoto et al. | 84/229 |
| 2009/0314156 | A1 * | 12/2009 | Komatsu | 84/626 |
| 2011/0185876 | A1 * | 8/2011 | Fujiwara et al. | 84/21 |
| 2013/0061733 | A1 * | 3/2013 | Ohnishi et al. | 84/174 |
| 2013/0180376 | A1 * | 7/2013 | Matsuo et al. | 84/225 |
| 2013/0180377 | A1 * | 7/2013 | Oba et al. | 84/229 |
| 2014/0305285 | A1 * | 10/2014 | Oba et al. | 84/603 |
| 2014/0305286 | A1 * | 10/2014 | Fujiwara et al. | 84/603 |

FOREIGN PATENT DOCUMENTS

| | | | |
|---|---|---|---|
| JP | 2007256360 | A | 10/2007 |
| JP | 2009230001 | A | 10/2009 |

OTHER PUBLICATIONS

Extended European Search Report dated Jun. 26, 2014, issued in corresponding European Patent Application No. 13012002.5.

* cited by examiner

MUSICAL INSTRUMENT EQUIPPED WITH A PEDAL, AND METHOD THEREFOR

BACKGROUND

The present invention relates to musical instruments (e.g., pianos) equipped with pedals, such as a damper pedal, for controlling sounding members (strings), and techniques and methods for processing data related to performance operation of the pedal.

Apparatus for recording positions of a damper pedal of a piano and automatically controlling the position of the damper pedal on the basis of the thus-recorded pedal positions have been known, one example of which is a pedal position recording/reproduction apparatus disclosed in. U.S. Pat. No. 5,714,702 corresponding to Japanese Patent No, 2,993,424. The pedal position recording/reproduction apparatus disclosed in the No. 2,993,424 patent detects positions of the pedal (pedal positions) by a sensor and converts the detected pedal positions into pedal positions in an ordinary piano to record the thus-converted pedal positions. Further, the pedal position recording/reproduction apparatus disclosed in U.S. Pat. No. 5,714,702 patent converts the recorded pedal positions into pedal positions corresponding to inherent characteristics of the piano and controls the pedal to take the converted pedal positions.

In pianos, as generally known, a plurality of component parts are disposed between the damper pedal and the dampers, and the dampers are ultimately displaced or moved by a force transmitting direction and amount of displacement, corresponding to operation of the damper pedal, being changed via such a plurality of component parts. However, with the apparatus disclosed in the U.S. Pat. No. 5,714,702 patent (No. 2,993,424 Japanese Patent), which detects and records positions of the damper piano, it is difficult to acutely record and reproduce positions of the dampers because displacement amounts of the damper pedal and the dampers differ from each other.

SUMMARY OF THE INVENTION

In view of the foregoing prior art problems, it is an object of the present invention to provide a technique for permitting accurate recording and/or reproduction of positions of a control member that varies in position relative to a sounding member in response to operation of a pedal.

In order to accomplish the above-mentioned object, the present invention provides an improved musical instrument, which comprises: a pedal configured to be displaceable in response to user's operation; a driven member configured to be displaceable in interlocked relation to displacement of the pedal; a control member configured to vary in its position relative to a sounding member, in response to displacement of the driven member, to thereby control the sounding member; a drive section configured to drive the driven member; a sensor configured to detect a position of the driven member; a first database storing therein correspondency relationship between positions of the pedal and positions of the driven member; a second database storing therein correspondency relationship between the positions of the pedal and control values; and a first output section configured to: acquire, from the first database, a position of the pedal corresponding to a position of the driven member detected by the sensor; acquire, from the second database, a control value corresponding to the acquired position of the pedal; and output the acquired control value as pedal operation information.

According to the present invention arranged in the aforementioned manner, a position of the control member (e.g., damper), whose relative position to the sounding member varies in response to user's operation of the pedal (e.g., damper pedal), can be detected with a high accuracy on the basis of position detection of the driven member (e.g., lifting rail) nearer to the control member. Further, because the detected position data is converted into a control value corresponding to a position of the pedal (pedal position) and such a control value is output as performance information, the present invention can provide highly versatile performance information based on the pedal position.

In an embodiment, the musical instrument may further comprise: a third database storing therein correspondency relationship between the positions of the pedal and positions of the control member; a fourth database storing therein correspondency relationship between the positions of the control member and the positions of the driven member; a second output section configured to acquire, from the second database, a position of the pedal corresponding to an input control value; acquire, from the third database, a position of the control member corresponding to the acquired position of the pedal; acquire, from the fourth database, a position of the driven member corresponding to the acquired position of the control member; and output, as an instructed position, the position of the driven member acquired from the fourth database; and a control section configured to control the drive section to position the driven member at the instructed position output by the second output section. With such arrangements, the driven member (e.g., lifting rail) disposed nearer to the control member (e.g., damper) is positioned in accordance with the control value corresponding to the pedal position, and thus, it is possible to automatically reproduce, with a high accuracy, the position of the control member (e.g., damper) based on the control value.

In an embodiment, the control value output by the first output section may be recorded into a recording medium. In an embodiment, the control value recorded in the recording medium may be input to the second output section. In an embodiment, the third database may store therein a first virtual position of the control member in association with a position of the pedal in a range where the control member is not displaced even when the pedal is displaced, and the fourth database may store therein a second virtual position of the control member in association with a position of the driven member in a range where the control member is not displaced even when the driven member is displaced.

Further, in an embodiment, the control values stored in the second database may each be a value obtained by normalizing a position of the pedal. In an embodiment, the pedal may he a damper pedal, and the control member may be a damper for damping vibration of the sounding member.

According to another aspect of the present invention, there is provided an improved musical instrument, which comprises: a pedal configured to be displaceable in response to user's operation; a driven member configured to be displaceable in interlocked relation to displacement of the pedal; a control member configured to vary in its position relative to a sounding member, in response to displacement of the driven member, to thereby control the sounding member; a drive section configured to drive the driven member; a sensor configured to detect a position of the driven member; a first database storing therein correspondency relationship between positions of the pedal and control values; a second database storing therein correspondency relationship between the positions of the pedal and positions of the control member; a third database storing therein correspondency relationship between the positions of the control member and positions of the driven member; an output section configured to: acquire, from the first database, a position of the pedal corresponding to an input control value; acquire, from the second database, a position of the control member corresponding to the acquired position of the pedal; acquire, from the third database, a position of the driven member corresponding to the acquired position of the control member; and output, as an instructed position, the position of the driven member acquired from the third database; and a control section configured to control the drive section to position the driven member at the instructed position output by the output section. With such arrangements, the driven member (e.g., lifting rail) disposed nearer to the control member (e.g., damper) is positioned in accordance with the control value corresponding to the pedal position, and thus, it is possible to automatically reproduce, with a high accuracy, the position of the control member (e.g., damper) based on the control value.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE INVENTION

[First Embodiment]

Figure 1:
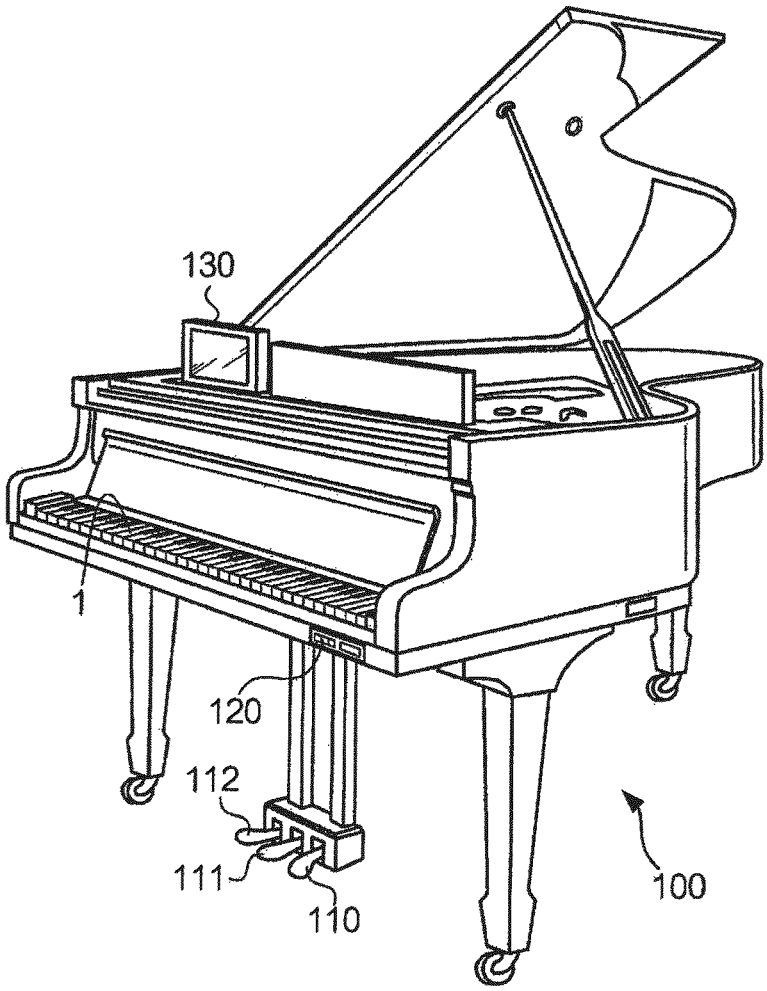
FIG. 1 is a perspective view showing an example outer appearance of a player piano according to a first embodiment of the present invention.

FIG. 1 is a perspective view showing an example outer appearance of a grand piano 100 with an automatic performance function (i.e., auto-playing piano or player piano) according to a first embodiment of the present invention. The player piano 100 includes a plurality of keys 1 provided on its front side facing a human player or user of the player piano 100, and a damper pedal 110, a sostenuto pedal 111 and a soft pedal 112 provided beneath the keys 1. The piano 100 further includes an access section (recording means and control value acquisition means) 120 for accessing a recording medium, such as a DVD (Digital Versatile Disk) or CD (Compact Disk), to read out or write performance data of a MIDI (Musical Instrument Digital Interface) format from or to the recording medium, and it also includes, beside a music rack or stand, a liquid crystal display for displaying, among other things, various menu screens far manipulating the automatic performance function of the piano 100, and an operation panel 130 having a touch panel that functions as a reception means for receiving various instructions from a human operator.

Figure 2:
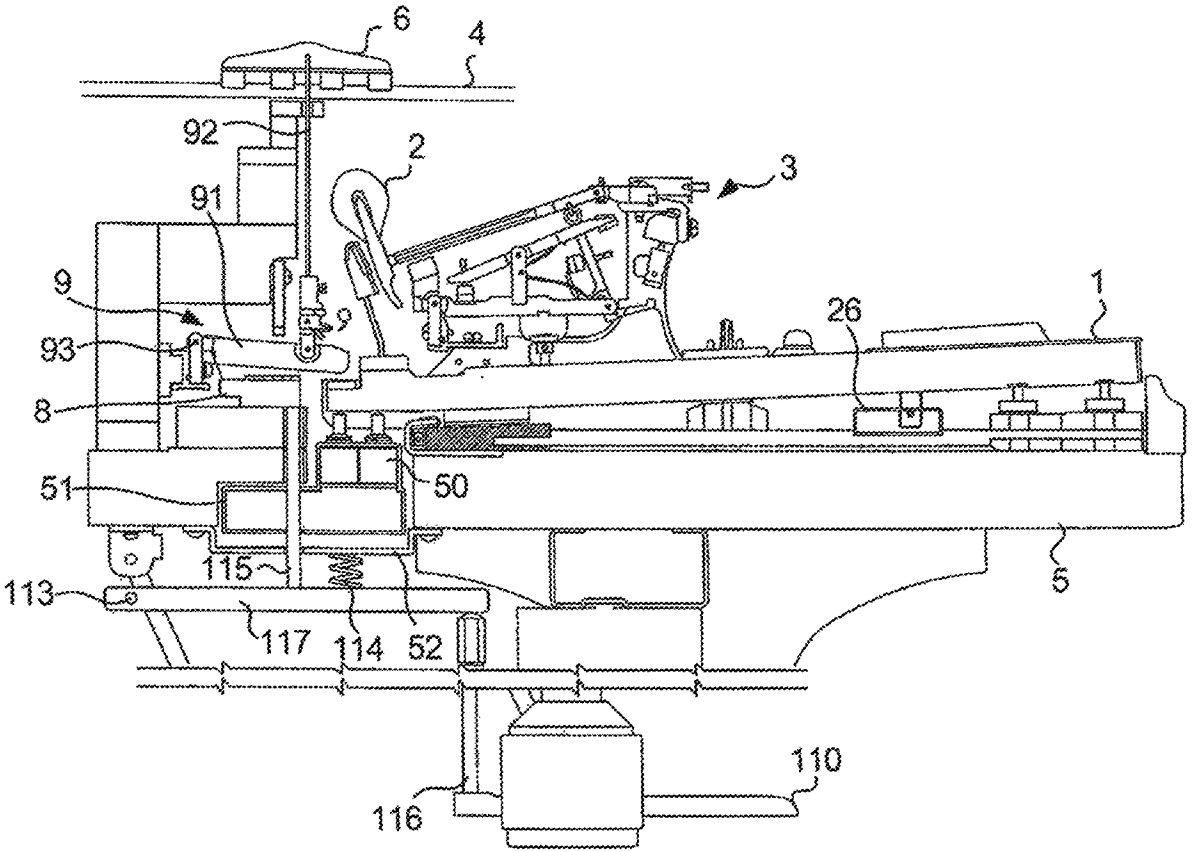
FIG. 2 is a side view schematically showing an example inner construction of the player piano shown in FIG. 1.

FIG. 2 is a schematic side view showing an example inner mechanical construction of the player piano 100. For each of the keys 1, the player piano 100 includes, among other things, a hammer action mechanism 3, a solenoid 50 for driving the key 1, a key sensor 26, a damper pedal 110, and a damper mechanism 9 for moving a damper 6. The right side in FIG. 2 is the front side of the piano 100 as viewed from a human player, while the left side in FIG. 2 is the rear side of the piano 100 as viewed from the human player. Although only one key 1 is shown in FIG. 2, eighty-eight (88) such keys 1 are provided side by side in a left-right direction as viewed from the human player. Accordingly, eighty-eight hammer action mechanisms 3 and eighty-eight key sensors 26 are provided in corresponding relation to the eighty-eight keys 1. Also, eighty-eight key-driving solenoids 50 are provided in corresponding relation to the eighty-eight keys 1, one key-driving solenoid 50 per key 1. As viewed from above (i.e., as viewed in top plan), the eighty-eight solenoids 50 are arranged in two rows, i.e. front-side and rear-side horizontal rows, with forty-four solenoids 50 in the front-side horizontal row and forty-four solenoids 50 in the rear-side horizontal row. Although it appears in FIG. 2 as if two solenoids 50 are provided per key 1, the front-side solenoid 50 in FIG. 2 is for (i.e., corresponds to) the key 1 shown in the figure, and the rear-side solenoid 50 located to the left of the front-side solenoid 50 in FIG. 2 is for another key 1 adjoining that key 1 shown in the figure.

As well known, each of the keys 1 is pivotably supported for depressing operation by the human player. Each of the hammer action mechanisms 3 having hammers 2 is a mechanism for hitting strings (i.e., sounding members) 4 provided in corresponding relation to the key 1. As the key 1 is depressed by the human player, the hammer 2 hits the strings 4 in response to motion of the key 1. In an automatic performance, each of the solenoids 50 is used for automatically driving the corresponding key 1. The solenoid 50 is accommodated in a case 51 that is provided in a hole formed in a keybed 5 of the piano 100. The hole formed in the keybed 5 is covered with a cover 52. Once a solenoid-driving signal is supplied to the solenoid 50, the plunger of the solenoid 50 is displaced. As the plunger is displaced to push the key 1 upwardly, the hammer 2 hits the strings 4 in response to the motion of the key 1. The key sensor 26 is provided below a front (right in FIG. 2) end portion of the key 1 for detecting a vertical position of the key varying in response to a performance and outputs a signal indicative of the detected position.

The damper pedal 110 is a pedal for moving the dampers 6. In FIG. 2, a front end portion (right end portion in the figure) of the damper pedal 110 is depressed or operated by a human player's foot. In the illustrated example of FIG. 2, a damper pedal rod 116 is connected to a rear end portion (left end portion in the figure) of the damper pedal 110. The damper pedal rod 116 has and upper end contacting the lower surface of a front end portion (right end portion in the figure) of a damper pedal lever 117. The damper pedal lever 117 is pivotally supported by a pin 113 so that it can pivot about the pin 113. A spring 114 (that is a resilient member for returning the damper pedal lever 117 and the damper pedal 110 to their original position) and a lifting rod 115 are fixed in contact with the upper surface of the damper pedal lever 117.

The spring 114, which is for example a metal coil spring, has an upper end contacting the cover 52. The spring 114 normally urges the damper pedal lever 117 in such a direction as to pivot clockwise (downward) about the pin 113. Note that any other resilient member, such as rubber, may replace the metal spring 114 as long as it imparts the damper pedal lever 117 with biasing force that causes the damper pedal lever 117 to pivot clockwise about the pin 113. The lifting rod 115 has an upper end contacting the lower surface of a lifting rail 8 that is an elongated member extending horizontally along the row of the keys 1 through holes formed in the cover 52, case 51 and keybed 5. The lifting rail (driven member) 8 is provided for moving the damper mechanisms 9. More specifically, the lifting rail 8 is disposed underneath the damper mechanisms 9 corresponding to the individual keys 1, and it is a bar-shaped component part extending in the left-right direction as viewed from the human player.

Each of the damper mechanisms 9, provided for moving the dampers (control members) 6, includes a damper lever 91 and a damper wire 92. The damper lever 91 is pivotably supported at one end by a pin 93, and the damper wire 92 is connected at one end (lower end in FIG. 2) to the other end of the damper lever 91. The damper wire 92 is connected at the other end (upper end in FIG. 2), opposite from the one end, to the damper 6. Namely, in the piano 100, a plurality of displaceable dampers 6 and a plurality of damper levers 91 pivotable for vertically displacing the dampers 6 are provided for damping vibration of corresponding ones of the strings (sounding members) 4.

When the human player is not touching the damper pedal 110, the damper pedal lever 117 and the damper pedal rod 116 are kept depressed downward by the spring 114, so that a front end portion of the damper pedal 110 is located at a predetermined position. As the human player steps on the front end portion of the damper pedal 110 against the biasing force of the spring 114, a rear end portion of the damper pedal 110 moves upward to cause the damper pedal rod. 116 to move up. By such upward motion of the damper pedal rod 116, the front end portion of the damper pedal lever 117 is pushed upward so that the damper pedal lever 117 pivots counterclockwise, so that the lifting rod 115 is pushed upward. As the lifting rod 115 is pushed upward like this, the lifting rail (elongated member) 8 is pushed upward. The lifting rail (driven member) 8 pushed upward like this abuts against the plurality of damper levers 91 to collectively pivot the damper levers 91. As the damper levers 91 pivot like this, each of the damper wire 92 is pushed upward, so that each of the dampers 6 moves away from the contact with the corresponding strings 4. Namely, a relative position of the dampers 6 to the strings 4 varies in response to displacement of the lifting rail (driven member) 8. Namely, the lifting rail (driven member) 8 is constructed to be displaceable for collectively pivot the plurality of damper levers 91.

Further, as the human player releases the foot from the damper pedal 110, the front end portion of the damper pedal lever 117 moves downward by the biasing force of the spring 114, thereby depressing the damper pedal rod 116. In response to the depression of the damper pedal rod 116, the rear end portion of the damper pedal 110 moves downward, so that the front end portion of the damper pedal 110 returns to the original position. Also, as the front end portion of the damper pedal lever 117 moves down, the lifting rod 115 moves downward, so that the lifting rail 8 also moves downward. Then, the plurality of damper levers 91 pivot downward together, in response to which the corresponding damper wires 92 move downward so that each of the dampers 6 holds the corresponding strings 4.

Figure 3:
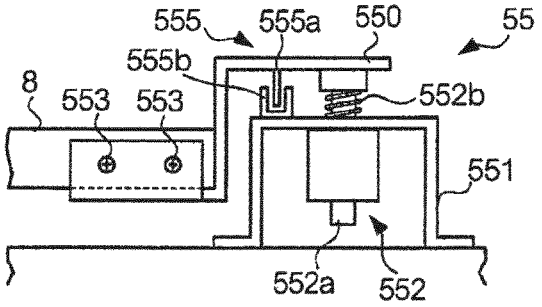
FIG. 3 is a front view showing an example construction of a rail drive section for collectively driving a plurality of damper levers in the player piano shown in FIG. 1.

The following describe a construction for driving the lifting rail (driven member) 8 by use of an actuator. FIG. 3 is a front view of a rail drive section 55 provided on any one of longitudinal end portions of the lifting rail (driven member) 8 for driving the lifting rail 8. The rail drive section 55 includes a connection member (or transmission member) 550, a frame 551, a solenoid 552 that is an example of the actuator, and screws 553. Whereas, in the illustrated example, the rail drive section 55 is provided on a right end portion of the lifting rail 8 as viewed from the human, the rail drive section 55 may be provided on a left end portion of the lifting rail 8 as viewed from the human player.

Figure 4:
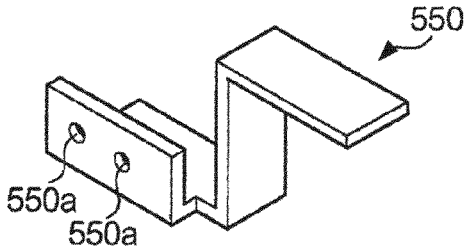
FIG. 4 is a perspective view showing an example of a connection member for transmitting driving force of an actuator to a lifting rail (driven member) in the player piano shown in FIG. 1.

The connection member 550, which is a transmission member for transmitting motion of the actuator (solenoid) 552 to the lifting rail (driven member) 8, is provided on a front-side longitudinal edge portion of the lifting rail 8 and projects substantially laterally from the right end of the lifting rail 8. More specifically, the connection member 550 is formed in a stepwise shape by bending a flat metal piece vertically upward at one position a predetermined distance from one end thereof and then bending the metal piece horizontally at another position a predetermined distance from the one position, as shown in FIG. 4. A portion of a lower front side region of the stepwise-shaped flat metal piece is bent vertically upward, and such a vertically-bent portion has holes 550*a* formed therein for passage therethrough of screws 553. The connection member 550 is fixed to a right end region of a front-side longitudinal edge portion of the lifting rail 8 by means of the screws 553 passed through the holes 550*a*. Note that the connection member 550 may be formed of any other suitable material than metal, such as synthetic resin or wood. Further, the connection member 550 may be fixed to the lifting rail 8 by an adhesive rather than the screws 553. The connection member 550 functions as a transmission means for transmitting linear motion of a later-described plunger 552*a* to the lifting rail 8.

The frame 551, which is a member for fixedly positioning the electromagnetic solenoid (actuator) 552, is fixed to the upper surface of the keybed 5 laterally beside a right end portion of the lifting rail (driven member) 8. The frame 551 had a hole formed therein for passage therethrough of the plunger 552*a* of the solenoid (actuator) 552. With the solenoid 552 fixed to the frame 551, the solenoid 552 is located at a distance above the keybed 5 as shown in FIG. 3, and one end of the plunger 552*a* projects upwardly beyond the frame 551. Note that the frame 551 too may he formed of any other suitable material than metal, such as synthetic resin or wood.

The solenoid 552 includes the plunger 552*a* and a spring 552*b*. The plunger 552*a* extends through a frame of the solenoid 552*a* and has the one end contacting the underside of an upper portion of the stepwise-shaped connection member 550. While no electric current is flowing through the solenoid 552, the plunger 552*a* is held in contact with the connection member 550 by the biasing force of the spring 552*b*. Once an electric current flows through the solenoid 552, the plunger 552*a* moves upwardly to push upwardly the connection member 550, in response to which the lifting rail 8 having the connection member 550 fixed thereto moves upwardly. Specifically, a front-side longitudinal edge portion of the lifting rail 8 moves upwardly so that the lifting rail 8 pivots about its imaginary longitudinal axis. Namely, the actuator (solenoid) 552 is arranged to apply its driving force to the front-side longitudinal edge portion of the lifting rail 8 in such a manner that the lifting rail 8 pivots about its imaginary longitudinal axis of the lifting rail 8. More specifically, in order to transmit the motion of the actuator (solenoid) 552 to the lifting rail (driven member) 8, the connection member 550 is fixed to the lifting rail 8 in such a manner as to project generally laterally beyond one end of the longitudinal edge portion of the lifting rail 8, and the connection member 550 is driven by the actuator (solenoid) 552 so that the driving force of the actuator (solenoid) 552 acts on the lifting rail (driven member) 8 via the connection member 550. Note that the solenoid 552 may alternatively be a push-type solenoid that does not have the spring 552*b*.

A position sensor 555 is provided in association with the frame 551. The position sensor 555 includes a transparent or light-permeable plate 555*a* and a detection section 555*b* so that it functions as a sensor for detecting a displaced position of the lifting rail (driven member) 8. The light-permeable plate 555*a* is a plate-shaped member formed of light-permeable synthetic resin. The light-permeable plate 555*a* is made in such a manner that an amount of light permeable therethrough differs depending on a position of the light-permeable plate 555*a*, i.e. in such a manner that the amount of light permeable through the light-permeable plate 555*a* increases as the light-permeable plate 555*a* gets farther from the connection member 550. The detection section 555*b* is a photo sensor comprising a combination of a light emitting portion and a light receiving portion. Light emitted from the light emitting portion transmits through the light-permeable plate 555*a* and is received by the light receiving portion. The detection section 555*b* outputs an analog signal ya corresponding to an amount of the light received by the light receiving portion. With such arrangements, the amount of light transmitted through the light-permeable plate 555*a* and reaching the light receiving portion varies as the position of the lifting rail 8 varies in the vertical (or up-down) direction. Thus, the analog signal ya output from the detection section 555*b* varies in response to a variation of the vertical position (i.e., position in the up-down direction) of the lifting rail 8 and indicates a current vertical position of the lifting rail 8.

Figure 5:
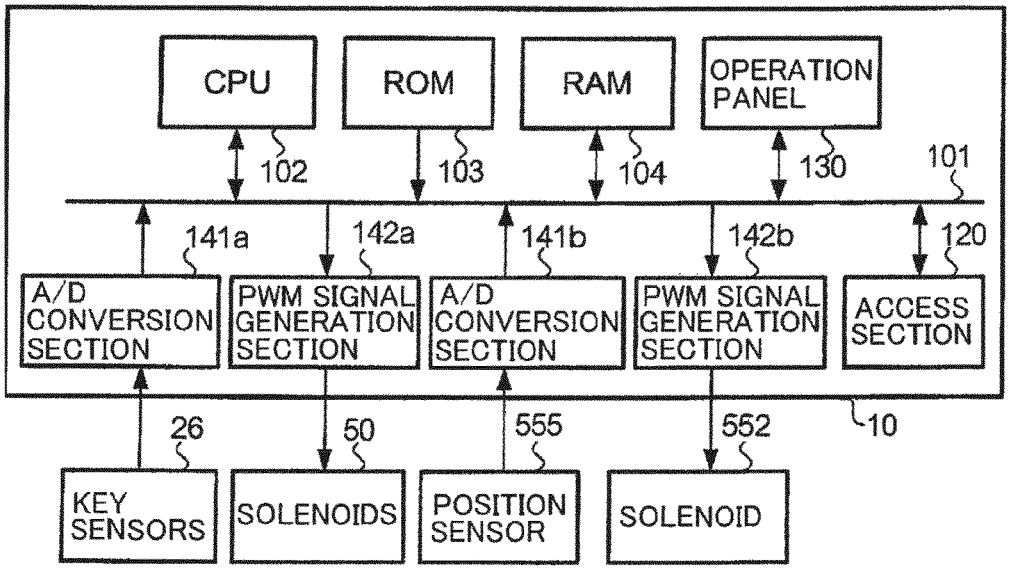
FIG. 5 is a schematic block diagram showing an example construction of electric/electronic circuitry of the player piano shown in FIG. 1.

Next, with reference to FIG. 5, a description will be given about an example electrical/electronic setup of the grand piano 100. More specifically, FIG. 5 is a schematic block diagram of a controller 10 which executes an automatic performance by controlling the aforementioned solenoids. As shown in FIG. 5, the controller 10 includes a CPU (Central Processing Unit) 102, a ROM (Read-Only Memory) 103, a RAM (Random Access Memory) 104, the access section 120 and the operation panel 130, and these components are connected to a bus 101. The controller 10 also includes A/D conversion sections 141*a* and 141*b* and PWM (Pulse Width Modulation) signal generation sections 142*a* and 142*b* connected to the bus 101, and the controller 10 controls the solenoids 50 and 552 using these components.

The A/D conversion section 141*a* converts an analog signal output from any one of the key sensors 26 to a digital signal and outputs the converted digital signal to a motion controller 1000*a*. The digital signal is indicative of a vertical position of the corresponding key 1 that varies in response to a performance operation.

The A/D conversion section 141*b* converts an analog signal output from the position sensor 555 to a digital signal and outputs the converted digital signal to a motion controller (control section) 1000*b*. Because the signal output from the position sensor 555 is indicative of a vertical position of the lifting rail 8 as noted above, the converted digital signal yd too is indicative of the vertical position of the lifting rail 8.

The CPU 102 executes a control program, stored in the ROM 103, using the RAM 104 as a working area. By the execution of the control program stored in the ROM 103, the automatic performance function is implemented in which the solenoids are driven in accordance with performance data read out from a recording medium inserted in the access section 120.

Figure 6:
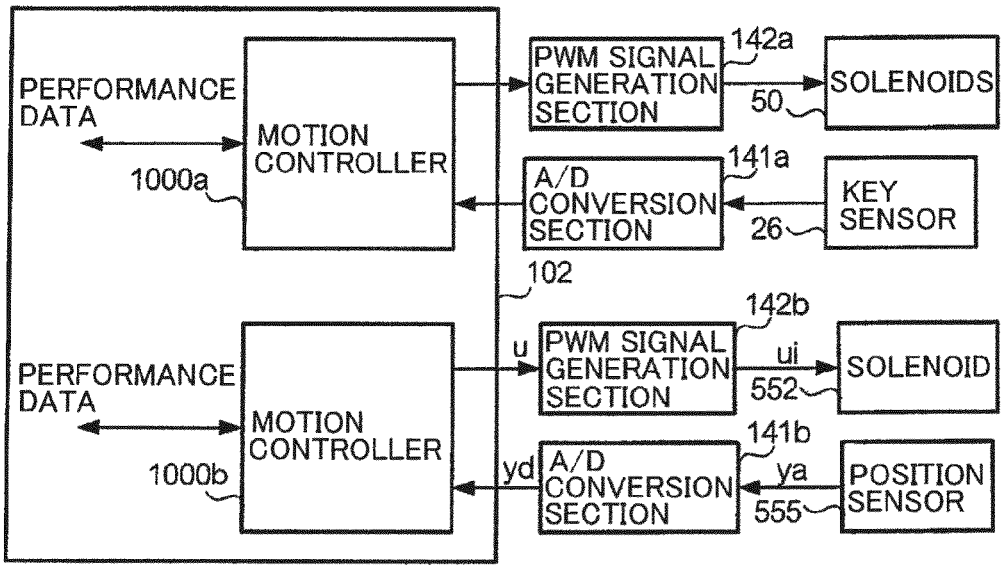
FIG. 6 is a schematic block diagram showing example functional arrangements related to the automatic performance function of the player piano.

FIG. 6 is a schematic block diagram showing example functional arrangements related to the automatic performance function. As shown in FIG. 6, the motion controllers 1000*a* and 1000*b* are implemented in the CPU 102. The motion controller 1000*a* has a function for driving a key 1 on the basis of performance data, in which case the motion controller 1000*a* acquires performance data of the MIDI format read out from a recording medium by the access section 120. Note that the performance data acquired by the motion controller 1000*a* here is a note-on/off message that is data related to driving of a key 1. Once a note-on/off message is acquired, the motion controller 1000*a* identifies a particular key 1 to be driven, but also calculates, on the basis of velocity data included in the acquired note-on/off message, a vertical position of the key 1 corresponding to the passage of time.

From a result of such calculation, the motion controller 1000*a* identifies the vertical position of the key 1 corresponding to the passage of time. Further, the motion controller 1000*a* acquires a signal supplied from the A/D conversion section 141*a* and calculates a position deviation that is a difference between a vertical position of the key 1 indicated by the signal acquired from the A/D conversion section 141*a* and the identified vertical position of the key 1. Then, the motion controller 1000*a* multiplies the calculated position deviation by a predetermined amplification factor to thereby convert a position-component control amount represented by the position deviation ex into a value corresponding to a duty ratio to be used in the PWM signal generation section 142*a*, and outputs the converted value as a control value for controlling the vertical position of the key 1. The motion controller 1000*a* also outputs a key number of the key 1 to be driven.

The PWM signal generation section 142*a* acquires the key number and control value output from the motion controller 1000*a*, converts the control value into a PWM signal and outputs the PWM signal to the solenoid 50 corresponding to the key 1 indicated by the acquired key number. Upon receipt of the PWM signal, the solenoid 50 displaces the plunger in accordance with the PWM signal to thereby drive the key 1.

The motion controller 1000*a* further includes a function for outputting, in response to a performance executed by the user, performance data of the MIDI format indicative of the performance. More specifically, once the user operates a key 1, an analog signal output from the corresponding key sensor 26 is converted into a digital signal via the A/D conversion section 141*a*, so that a signal indicative of a vertical position of the key us supplied to the motion controller 1000*a*.

On the basis of the digital signal, the motion controller 1000*a* identifies a vertical position of the key 1 varying in accordance with the passage of time, determines an operating velocity of the key 1 on the basis of relationship between a time variation and the identified vertical position of the key 1, and generates velocity data of the MIDI format from the thus-determined operating velocity. Further, the motion controller 1000*a* identifies the operated key 1 and converts the key number of the operated key 1 into a note number of the MIDI format.

Furthermore, the motion controller 1000*a* generates a note-on/off message using the generated velocity data and note number data and outputs the generated note-on/off message and time information indicative of a time at which the key 1 has been operated. Then, performance data of the MIDI format is generated on the basis of the note-on/off message and time information and recorded into a recording medium by the access section 120.

Figure 7:
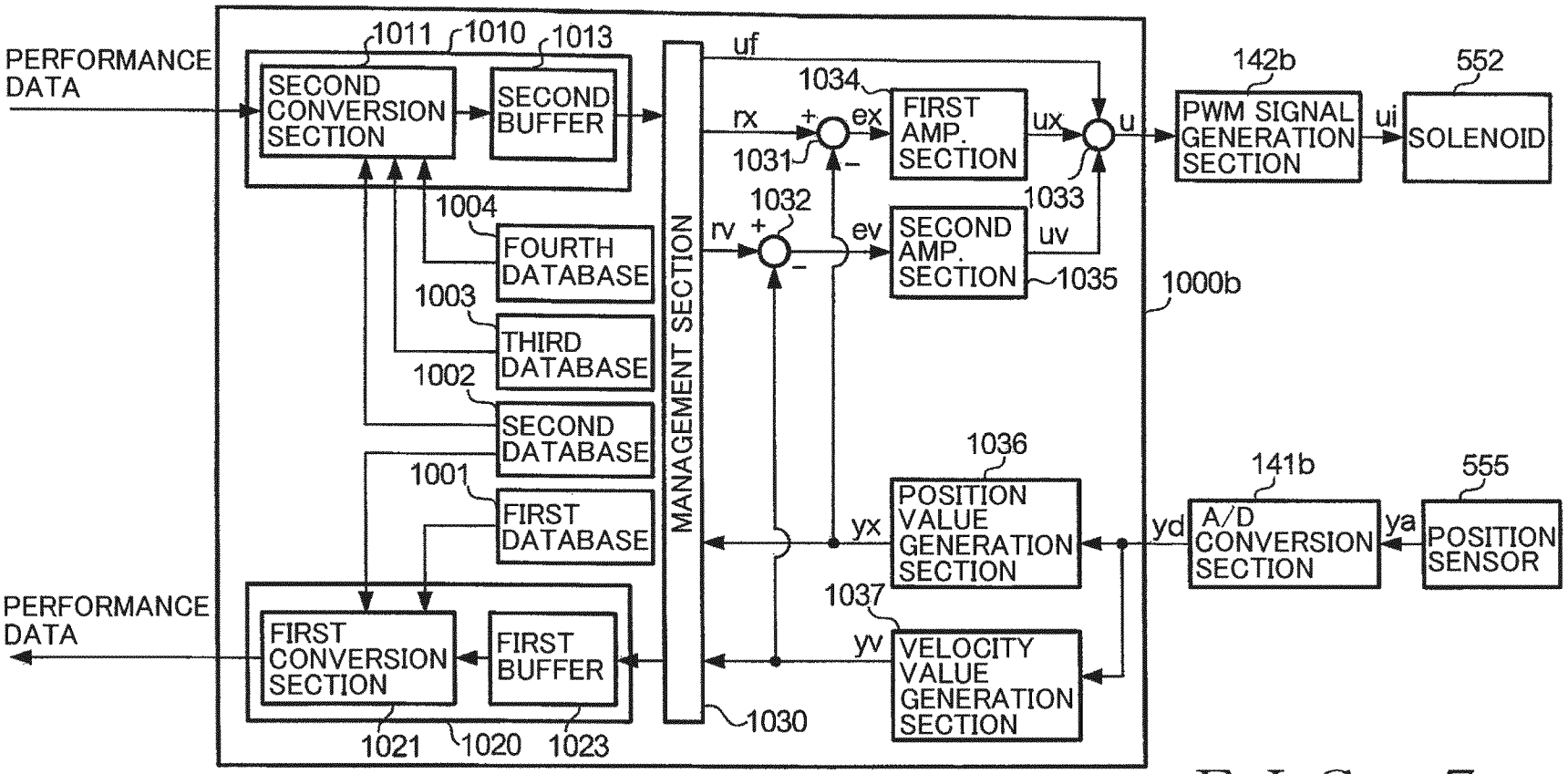
FIG. 7 is a schematic block diagram showing example functional arrangements of a motion controller shown in FIG. 6.

The following describe the motion controller (control section) 1000*b*. FIG. 7 is a schematic block diagram showing example functional arrangements of the motion controller (control section) 1000*b*. The motion controller 1000*b* has a function for driving the dampers 6 on the basis of performance data, and a function for generating performance data indicative of user's operation of the damper pedal 110.

In FIG. 7, a position value generation section 1036 performs a smoothing process on a digital signal yd, and it outputs a value, obtained through the smoothing process, as a position value yx indicative of a position of the lifting rail 8.

A velocity value generation section 1037 generates a velocity value yv indicative of a moving velocity of the lifting rail 8. More specifically, the velocity value generation section 1037 calculates a moving velocity of the lifting rail 8 by performing a temporal differentiation process on sequentially supplied digital signals yd and outputs a velocity value yv indicative of the moving velocity of the lifting rail 8.

Figure 8:
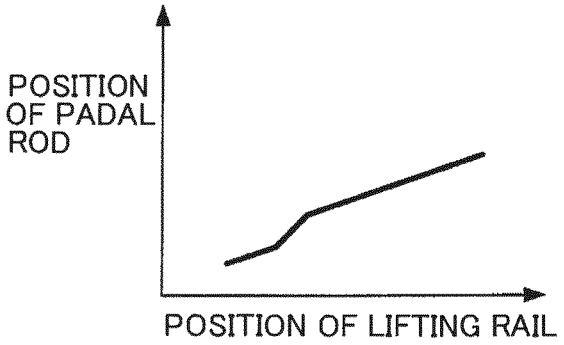
FIG. 8 is a graph showing an example of correspondency relationship between various possible positions of a lifting rail and various possible positions of a pedal rod in the piano.

In FIG. 7, a first database 1001 has prestored therein correspondency relationship between various possible vertical positions of the lifting rail 8 and various possible vertical positions of the damper pedal rod 116 (vertical positions of a rear end portion of the damper pedal 110). Namely, the first database 1001 has prestored therein correspondency relationship between positions of the damper pedal 110 (i.e., damper pedal positions) and positions of the lifting rail (driven member) 8. As noted above, as the damper pedal 110 is operated, the damper pedal rod 116 moves upward or ascends, in response to which the lifting rail 8 too ascends. Thus, the correspondency relationship between the vertical positions (position values yx) of the lifting rail 8 and the vertical positions of the damper pedal rod 116 is set such that, as the position of the damper pedal rod 116 rises, the position of the lifting rail 8 rises, as shown in FIG. 8. Because the first database 1001 has prestored therein, per position of the damper pedal rod 116, a position of the lifting rail 8 in association with the position of the damper pedal rod 116, it is possible to obtain a position of the damper pedal rod 116 on the basis of a position of the lifting rail 8 by reference to the first database 1001.

A second database 1002 is a database having prestored therein correspondency relationship between various values control change messages of the damper pedal can take in performance data of the MIDI format (hereinafter referred to as "MIDI values") and various possible vertical positions of the damper pedal rod 116. Namely, the second database 1002 has prestored therein correspondency relationship between various possible damper pedal positions and control values of the damper pedal. Because a variation in vertical position of the damper pedal rod 116 corresponds to a variation in vertical position of a rear end portion of the damper pedal 110, it can be said that a vertical position of the damper pedal rod 116 represents a vertical position of the rear end portion of the damper pedal 110. Namely, the second database 1002 has prestored therein, per vertical position of the damper pedal rod 116, a MIDI value in association with the vertical position of the damper pedal rod 116. Namely, the MIDI values stored in the second database 1002 are each a value obtained by normalizing the vertical position of the damper pedal rod 116. For example, in the second database 1002, MIDI value "0" indicating that the dampers 6 are in an OFF state (i.e., the dampers 6 are in a state contacting the strings 4) is associated with a vertical position of the damper pedal rod 116 when the damper pedal rod 116 is in its lowermost position (i.e., when the damper pedal 110 is in an non-operated or non-depressed position), MIDI value "64" is associated with a vertical position of the damper pedal rod 116 when the damper pedal 110 is in a half-depressed or half-pedal position. MIDI value "127" is associated with a vertical position of the damper pedal rod 116 when the damper pedal rod 116 is in its uppermost position (i.e., when the damper pedal 110 is in a fully-depressed or most-deeply-depressed position).

A third database 1003 is a database having prestored therein correspondency relationship between various possible vertical positions of the damper pedal rod 116 and various possible vertical positions of the dampers 6. Namely, the third database 1003 has prestored therein correspondency relationship between damper pedal positions and positions of the dampers (control members) 6. As the damper pedal rod 116 ascends, the dampers (control members) 6 ascend, as noted above. Thus, the correspondency relationship between the vertical positions of the damper pedal rod 116 and the vertical positions of the dampers 6 is set such that, as the position of the damper pedal rod 116 rises, the position of the lifting rail 8 and hence the dampers 6 rises. However, the dampers 6 do not ascend immediately in response to the start of ascending movement of the damper pedal rod 116, and thus, actually, there would occur a section or range where the dampers 6 do not vary in position (i.e., are not displaced) in response to the start of ascending movement of the damper pedal rod 116, as indicated by a broken line in FIG. 9. Thus, in the instant embodiment, virtual positions of the dampers 6 in that section or range (i.e., first virtual position) are obtained by extrapolation and stored in the third database 1003 as a replacement (indicated by a solid line) for the range i.e., broken-line range in FIG. 9). Namely, the third database 1003 has prestored therein the aforementioned correspondency relationship as indicated by a solid line in FIG. 9 including the above-mentioned first virtual positions, so that a vertical position of the dampers 6 can be obtained on the basis of a vertical position of the damper pedal rod 116 by reference to the third database 1003. Whereas, in the instant embodiment, the relationship as shown by the solid line in FIG. 9 is prestored in the third database 1003, relationship as indicated by the broken line in FIG. 9 may be prestored as-is for the range where the dampers 6 do not vary in position (i.e., are not displaced) in response to the ascending movement of the damper pedal rod 116, without the above-mentioned extrapolation being performed to obtain the first virtual positions.

Further, in FIG. 7, a fourth database 1004 is a database having prestored therein correspondency relationship between various possible vertical positions of the lifting rail 8 and various possible vertical positions of the dampers 6. Namely, the fourth database 1004 has prestored therein correspondency relationship between positions of the dampers (control members) 6 and positions of the lifting rail (driven member) 8. As the lifting rail 8 ascends, the dampers 6 ascend, as noted above. Thus, the correspondency relationship between the vertical positions of the lifting rail 8 and the vertical positions of the dampers 6 is set such that, as the position of the lifting rail 8 rises, the position of the dampers 6 rise. Because the dampers 6 do not ascend immediately in response to the start of ascending movement of the lifting rail 8, and thus, actually, there would occur a section or range where the dampers 6 do not vary in position (are not displaced) in response to the start of ascending movement of the lifting rail 8, as indicated by a broken line in FIG. 10. Thus, in the instant embodiment, virtual positions of the dampers 6 in that range (i.e., second virtual positions) are obtained by extrapolation and stored in the fourth database 1004 as a replacement (indicated by a solid line) for the range (i.e., broken-line range in FIG. 10). Namely, the fourth database 1004 has prestored therein the correspondency relationship as indicated by a solid line in FIG. 10 including the above-mentioned second virtual position, so that a vertical position of the lifting rail 8 can be obtained on the basis of a vertical position of the dampers 6 by reference to the fourth database 1004. Whereas, in the instant embodiment, the relationship as indicated by the solid line in FIG. 10 is prestored in the fourth database 1004, relationship as indicated by the broken line in FIG. 10 may be prestored as-is for the range where the dampers 6 do not vary in position in response to the ascending movement of the lifting rail 8, without the above-mentioned extrapolation being performed to obtain the second virtual positions.

Figure 9:
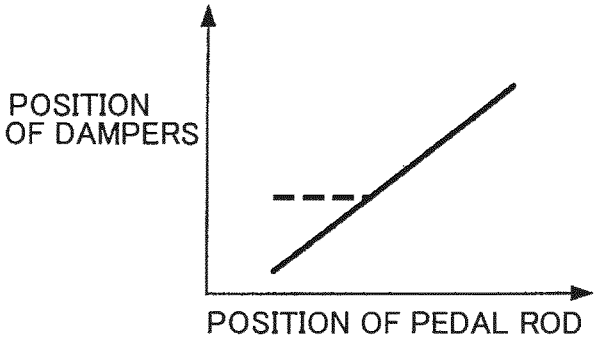
FIG. 9 is a graph showing an example of correspondency relationship between various possible positions of dampers and various possible positions of the pedal rod in the piano.
Figure 10:
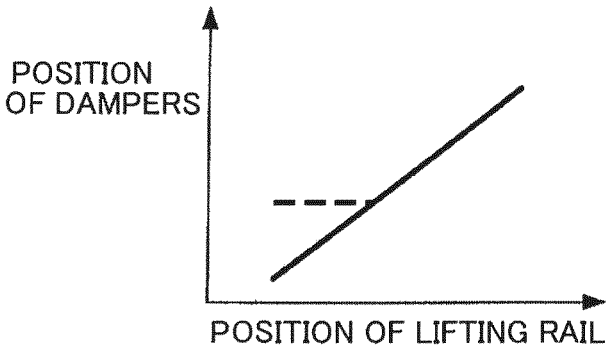
FIG. 10 is a graph showing an example of correspondency relationship between various possible positions of the dampers and various possible positions of the lifting rail in the piano.

Note that in each of the graphs of FIGS. 8 to 10, the vertical axis and the horizontal axis represent dimensionless values obtained by detecting positions by respective sensors and converting analog signals, output from the sensors, into digital signals.

Further, in FIG. 7, a performance data generation section 1020 comprises a first conversion section 1021 and a first buffer 1023. The first buffer 1 023 is a buffer for acquiring and storing position values yx output from the position generation section 1036 to the management section 1030. As the damper pedal 110 is operated by the user, the vertical position of the lifting rail 8 varies with the passage of time. If the damper pedal 110 is in the non-depressed or non-operated position at time point t1, in the half-pedal (half-depressed) position at time point t2 and in the fully-depressed position at time point t3, respective position values yx at these time points t1 to t3 are stored into the first buffer 1023 in the order of the time points.

The first conversion section (first output section) 1021 references the first database 1001 to acquire a vertical position of the damper pedal rod 116 associated with (or corresponding to) the position value yx of the lifting rail 8 stored in the first buffer 1023. Further, the first conversion section 1021 references the second database 1002 to acquire a MIDI value (control value) associated with (or corresponding to) the vertical position of the damper pedal rod 116 acquired from the first database 1001. Namely, by referencing the first and second databases 1001 and 1002, the first conversion section 1021 converts the position value yx into a dimensionless MIDI value (control value or pedal operation information). Then, the first conversion section 1021 outputs performance data of the MIDI format including the acquired MIDI value (control value or pedal operation information). Such performance data output from the first conversion section 1021 becomes a control change message pertaining to the driving of the dampers 6. The thus-output control change message is recorded into a suitable recording medium, such as a recording medium inserted in or attached to the access section 120, or the RAM 104, so that it can be used later an automatic performance. Alternatively, the control change message may be output in real time via a communication line and stored into a remote memory, or used to remotely control a pedal of another music instrument.

Further, in FIG. 7, a performance data analysis section 1010 comprises a second conversion section 1011 and a second buffer 1013. The second conversion section 1011 acquires performance data of the MIDI format read out from a recording medium by the access section 120. The performance data acquired by the second conversion section 1011 is a control change message that is related to driving of the dampers 6 (i.e., control value corresponding to an operating position of the damper pedal). Note that the performance data acquired by the performance data analysis section 1010 may be any other type of data than data read out from the recording medium by the access section 120, such as data transmitted from an external data source via a communication line. The second conversion section second output section) 1011 extracts a MIDI value (control value) included in the performance data. Once the second conversion section (second output section) 1011 extracts a MIDI value (control value) from sequentially-supplied performance data, it first references the second database 1002 to acquire a value associated with (or corresponding to the extracted MIDI value (control value), i.e. acquire a vertical position of the damper pedal rod 116. Then, the second conversion section 1011 references the third database 1003 to acquire a vertical position of the dampers 6 associated with (or corresponding to) the vertical position of the damper pedal rod 116 acquired from the second database 1002. Then, the second conversion section 1011 references the fourth database 1004 to acquire a vertical position of the lifting rail 8 corresponding to the vertical position of the dampers 6 acquired from the third database 1003 and outputs the thus-acquired value (vertical position of the lifting rail 8) to the second buffer 1013 as a position instruction value (indicative of an instructed position) rx.

The second buffer 1013 is a buffer for temporarily storing the position instruction value rx. For example, if the MIDI value differs among the sequentially-supplied performance data, and if the MIDI value at time point t1 is "0", the MIDI value at time point t2 is "64" and the MIDI value at time point t3 is "127", then a set of time point t1 and the position instruction value rx at time point t1, a set of time point t2 and the position instruction value rx at time point t2 and a set of time point t3 and the position instruction value rx at time point 13 are sequentially stored into the second buffer 1013 in the order of the time points.

The management section 1030 acquires the time points and position instruction values rx stored in the second buffer 1013 and outputs the acquired position instruction values rx. Further, the management section 1030 acquires the sets of time points and position instruction values rx stored in the second buffer 1013 to perform a temporal differentiation process on the acquired sets of time points and position instruction values rx to thereby calculate a moving velocity of the lifting rail 8 and outputs a velocity instruction value ry indicative of the moving velocity of the lifting rail 8. Also, the management section 1030 outputs a predetermined fixed value uf. Furthermore, in FIG. 7, a first subtractor 1031 acquires the position instruction value rx output from the management section 1030 and the position value yx output from the position value generation section 1036. Then, the first subtractor 1031 performs an arithmetic operation of "position instruction value rx−position value yx" and outputs a position deviation ex, which is a result of the arithmetic operation, to a first amplification section 1034.

A second subtractor 1032 acquires the velocity instruction value ry output from the management section 1030 and the velocity value yv output from the velocity value generation section 1037. Then, the second subtractor 1032 performs an arithmetic operation of "velocity instruction value rv−velocity value yv" and outputs a velocity deviation ev, which is a result of the arithmetic operation, to a second amplification section 1035.

The first amplification section 1034 acquires the position deviation ex and multiplies the acquired position deviation ex by a predetermined amplification factor and outputs a result of the multiplication as a position control value ux. Namely, here, the first amplification section 1034 performs unit conversion for converting a position-component control amount represented by the position deviation ex into a value corresponding to a duty ratio to be used in the PWM signal generation section 142*b* provided at the following stage.

The second amplification section 1035 acquires the velocity deviation ev and multiplies the acquired velocity deviation ev by a predetermined amplification factor and outputs a result of the multiplication as a velocity control value uv. Namely, here, the second amplification section 1035 performs unit conversion for converting, a velocity-component control amount represented by the velocity deviation ev into a value corresponding to a duty ratio to be used in the PWM signal generation section 142*b* provided at the following stage.

An adder 1033 adds together the fixed value uf, position control value ux and velocity control value uv and outputs a result of the addition (i.e., sum) of these values as a control value u. The control value u is a value indicative of an electric current to be supplied to the solenoid 552 (in other words, a duty ratio to be used in the PWM signal generation section 142*b*).

The PWM signal generation section 142*b* outputs a PWM signal for driving the solenoid 552. More specifically, the PWM signal generation section 142*b* generates a PWM signal ui corresponding to the above-mentioned control value u and outputs the thus-generated PWM signal ui to the solenoid 552, so that the solenoid 552 having received the PWM signal ui displaces the plunger in accordance with the PWM signal ui.

[Behavior of the First Embodiment]

The following describe example behavior of the player piano 100. Particularly, the following describe behavior of the player piano 100 when motion of the dampers 6 responsive to a user's performance is to be stored as performance data, and behavior when the dampers 6 are to he driven on the basis of performance data stored in a recording medium.

[Behavior when Motion of the Dampers 6 Responsive to a User's Performance is to be Stored as Performance Data]

If the user performs, on the operation panel 130, operation for instructing storage of performance data, performance data representative of a performance executed by the user will be recorded into a recording medium inserted in the access section 120. For example, as the user steps on or depresses a front end portion of the damper pedal 110, a rear end portion of the damper pedal 110 moves upward, causing the damper pedal rod 116 to move upward. By the upward movement of the damper pedal rod 116, a front end portion of the damper pedal lever 117 is pushed upward so that the lever 117 pivots to thereby push up the lifting rod 115. As the lifting rod 115 is pushed upward like this, the lifting rail 8 is pushed upward.

As the vertical position of the lifting rail 8 varies in the aforementioned manner, the light-permeable plate 555*a* varies in position, so that the analog signal ya output from the detection section 555*b* varies. Such an analog signal ya is sampled and sequentially converted into digital signals yd by the A/D conversion section 141*b*. The digital signals yd obtained by the A/D conversion section 141*b* are sequentially output to the position value generation section 1036. The position value generation section 1036 performs the smoothing process on the sequentially-supplied digital signals yd and thereby outputs a position value yx indicative of a position of the lifting rail 8. Because the position of the lifting rail 8 varies in response to the operation of the damper pedal 110, such a position value yx too varies in response to the operation of the damper pedal 110.

The position value yx output from the position value generation section 1036 is supplied via the management section 1030 to the first buffer 1023 for storage therein. The first conversion section 1021 acquires, from the first database 1001, a vertical position of the damper pedal rod 116 associated with (corresponding to) the position value yx stored in the first buffer 102.3 and acquires, from the second database 1002, a MIDI value associated with the vertical position of the damper pedal rod 116 acquired from the first database 1001. Once the first conversion section 1021 acquires the. MIDI value, it outputs performance data of the MIDI format including the acquired MIDI value. Such performance data output from the first conversion section 1021 becomes a control change message pertaining to the driving of the damper pedal 110. The CPU 102 controls the access section 120 to store, into the recording medium, the performance data together with information indicative of a performance time.

[Behavior when the Dampers 6 are to be Driven on the Basis of Performance Data]

The following describe behavior of the player piano 100 when the dampers 6 are to be driven on the basis of performance data stored in a recording medium. First, once a recording medium having stored therein performance data of the MIDI format is inserted into the access section 120 and user's operation for reproducing the performance data from the recording medium is performed on the operation panel 130, the CPU 102 reads out the performance data from the recording medium. If, at that time, a control change message pertaining to the driving of the dampers 6 is read out as performance data, that performance data is supplied to the second conversion section 1011.

Once the second conversion section 1011 extracts a MIDI value from the acquired performance data, it references the second database 1002 to acquire a vertical position of the damper pedal rod 116 associated with the extracted MIDI value. Then, the second conversion section 1011 references the third database 1003 to acquire a vertical position of the dampers 6 associated with the acquired vertical position of the damper pedal rod 116. Then, the second conversion section 1011 acquires, from the fourth database 1004, a vertical position of the lifting rail 8 associated with the acquired vertical position of the dampers 6. After that, the second conversion section 1011 outputs the acquired vertical position of the lifting rail 8 to the second buffer 1013 as a position instruction value rx.

For example, if the MIDI value at time point t1 is "0", the MIDI value at time point t2 is "64" and the MIDI at time point t3 is "127", then a set of time point t1 and the position instruction value rx at time point t1, a set of time point t2 and the position instruction value rx at time point t2 and a set of time point t3 and the position instruction value rx at time point t3 are sequentially stored into the second buffer 1013 in the order of the time points.

Once the position instruction value rx is stored into the second buffer 1013, the management section 1030 acquires the time and position instruction value rx stored in the management section 1030 and outputs the acquired position instruction value rx. Further, the management section 1030 sequentially acquires the sets of the times and position instruction values rx stored in the second buffer 1013, performs temporal differentiation thereon to calculate a moving velocity of the lifting rail 8 and outputs a velocity instruction value ry indicative of the moving velocity.

The position sensor 555 outputs an analog signal ya indicative of a vertical position of the lifting rail 8, and such an analog signal ya is sequentially converted by the. A/D conversion section 141*b* into digital signals yd, on the basis of which the position value generation section 1036 outputs a position value yx indicative of the position of the lifting rail 8. The velocity value generation section 1037 calculates a moving velocity of the lifting rail 8 by performing a temporal differentiation process on the digital signals yd, and then, it outputs a velocity value yv indicative of the calculated moving velocity of the lifting rail 8.

The first subtractor 1031 acquires the position instruction value rx output from the management section 1030 and the position value yx output from the position value generation section 1036 and performs an arithmetic operation of "position instruction value rx−position value yx" to thereby output a position deviation ex, which is a result of the arithmetic operation, to the first amplification section 1034. The second subtractor 1032 acquires the velocity instruction value ry output from the management section 1030 and the velocity value yv output from the velocity value generation section 1037. Then, the second subtractor 1032 performs an arithmetic operation of "velocity instruction value rv−velocity value yv" to thereby output a velocity deviation ev, which is a result of the arithmetic operation, to the second amplification section 1035.

The first amplification section 1034 acquires the position deviation ex and multiplies the acquired position deviation ex by a predetermined amplification factor and outputs a result of the multiplication as a position control value ux. Further, the second amplification section 1035 acquires the velocity deviation ev and multiplies the acquired velocity deviation ev by a predetermined amplification factor and outputs a result of the multiplication as a velocity control value uv. The adder 1033 adds together the fixed value uf, position control value ux and velocity control value uv and outputs a result of the addition (i.e., sum) of these values as a control value u to the PWM signal generation section 142*b*. The PWM signal generation section 142*b* outputs a PWM signal ui corresponding to the above-mentioned control value u and outputs the thus-generated PWM signal ui to the solenoid 552, so that the solenoid 552 displaces the plunger in accordance with the PWM signal ui.

As the plunger 552*a* is displaced, the light-permeable plate 555*a* and the lifting rail 8 are displaced with the connection member 550. In response to the displacement (positional variation) of the light-permeable plate 555*a*, the analog signal ya output from the detection section 555*b* varies. This analog signal ya is converted into a digital signal yd and output to the position value generation section 1036 and the velocity value generation section 1037. The position value yx is fed back to the first subtractor 1031 while the velocity value yx is fed back to the second subtractor 1032, so that a control value u is output such that the position deviation ex and the velocity deviation ev decrease.

In the instant embodiment, when an automatic performance is to be executed on the basis of performance data, the dampers 6 are driven by the lifting rail 8 being driven or moved by the solenoid 552. As compared to the prior art construction where the damper pedal is driven by the solenoid to move the dampers, the instant embodiment of the present invention can move the dampers with an increased accuracy because there are fewer component parts between the component part driven by the solenoid and the dampers.

Further, in the instant embodiment, a position of the lifting rail 8 is converted into a vertical position of the damper pedal rod 116 by use of the first database 1001, and such a vertical position of the damper pedal rod 116 is recorded after being converted into a MIDI value. Because such a MIDI value is recorded on the basis of the position of the lifting rail 8 nearer to the dampers 6, a position of the dampers 6 can be recorded with an increased accuracy as compared to the prior art construction where a position of the damper pedal is detected and recorded.

[Second Embodiment]

The following describe a second embodiment of the player piano 100 of the present invention. The second embodiment of the player piano 100 is similar in construction to the above-described first embodiment, except that the construction of the motion controller 1000*b* in the second embodiment is different from that in the first embodiment. Thus, the following description focuses on differences of the second embodiment from the first embodiment.

Figure 11:
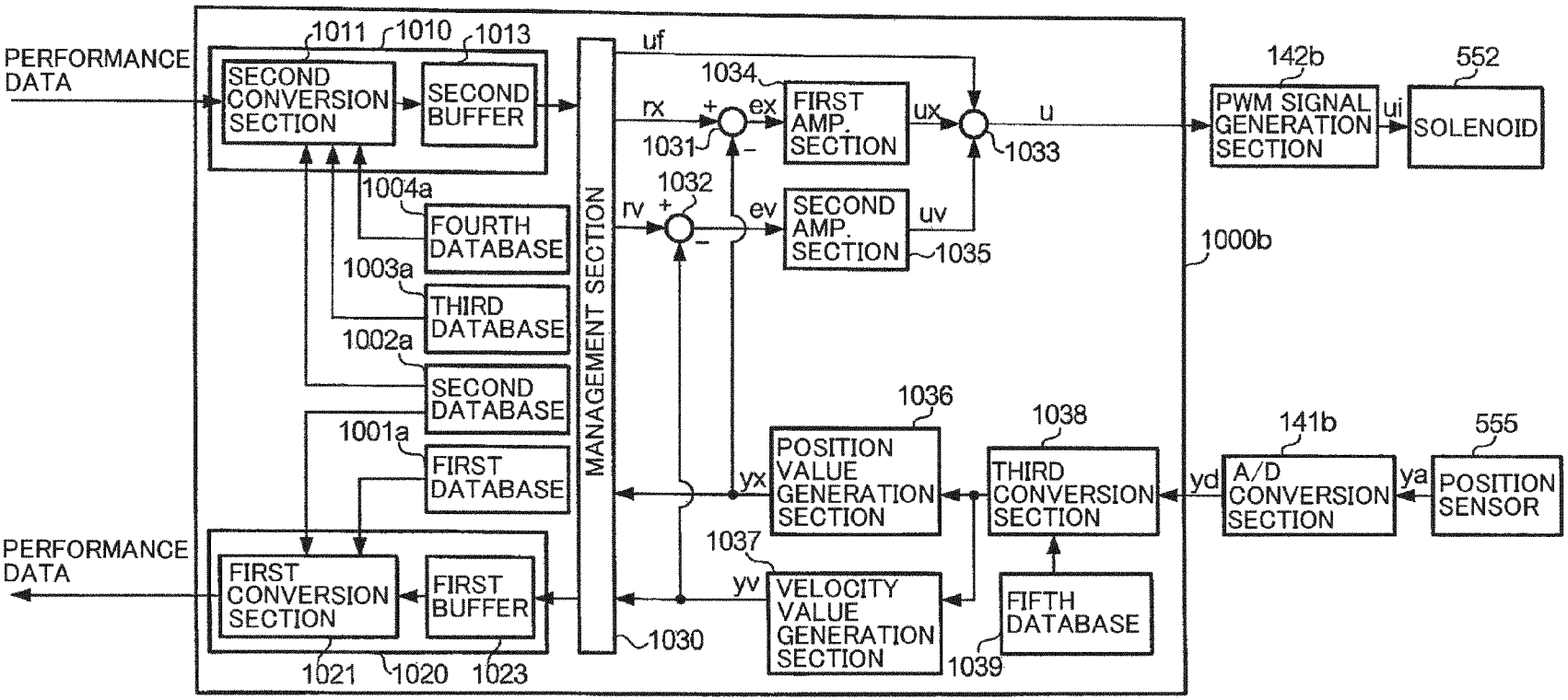
FIG. 11 is a schematic block diagram showing example functional arrangements of a motion controller in a second embodiment of the player piano of the present invention.

FIG. 11 is a schematic block diagram showing example functional arrangements of the motion controller 1000*b* in the second embodiment. The motion controller 1000*b* in the second embodiment includes a third conversion section 1038 and a fifth database 1039, in addition to a first database 1001*a*, a second database 1002*a*, a third database 1003*a* and a fourth database 1004*a*.

The fifth conversion section 1039 includes a table in which various values of the digital signal yd and various vertical positions of the lifting rail 8 are prestored in association with each other. Let it be assumed here that a position of the lifting rail 8 when the lifting rail 8 is not being pushed upward by the lifting rod 115 and plunger 552*a* is set as a reference vertical position of the lifting rail 8 and that such a reference vertical position of the lifting rail 8 is "0 mm", A predetermined value of the digital signal yd when the lifting rail 8 is in the "0 m" reference position is prestored in the table in association with the "0 mm" reference position. Let it also be assumed that the upwardmost or highest position of the lifting rail 8 moved by the lifting rod 115 and plunger 552*a* is 10 mm above the "0 mm" reference position, in which case a predetermined value of the digital signal yd when the lifting rail 8 is in the "10 mm" position is prestored in the fifth database 1039 in association with the "10 mm" position. For other positions between the "0 mm" reference position and the "10 mm" position as well, values of the digital signal yd and vertical positions of the lifting rail 8 are prestored in the table 1039 in association with each other.

The third conversion section 1038 references the fifth database 1039 to acquire a position value associated with the digital signal yd acquired from the A/D conversion section 141*b*. Namely, by referencing the fifth database 1039, the conversion section 1038 converts the digital signal yd into a physical amount indicating a position of the lifting rail 8 in millimeters (mm). The conversion section 1038 supplies the thus-acquired position value to the position value generation section 1036 and velocity value generation section 1037.

Because what is supplied to the position value generation section 1036 is a position value in mm (i.e., in the unit of mm), a position value yx supplied from the position value generation section 1036 to the second buffer and first subtractor 1031 too is in the unit of mm. Similarly, because what is supplied to the velocity value generation section 1037 is a position value in mm, a velocity value yv output from the velocity value generation section 1037 is a physical amount in the unit of mm/s.

The first database 1001*a* is a database having stored therein correspondency relationship between various possible vertical positions of the lifting rail 8 and various possible vertical positions of the damper pedal rod 116 (vertical positions of a rear end portion of the damper pedal 110). Note that the first database 1001*a* is different from the aforementioned first database 1001 in that the vertical positions of the lifting rail 8 stored in the first database 1001 a are physical amounts in mm (i.e., in the unit of mm).

The second database 1002*a* is a database having stored therein correspondency relationship between various values of control which change messages of the damper pedal can take in performance data of the MIDI format (hereinafter referred to as "MIDI values") and various possible vertical positions of the damper pedal rod 116. Note that the second database 1002*a* is different from the aforementioned second database 1002 in that the vertical positions of the damper pedal rod 116 stored in the second database 1002*a* are physical amounts in mm.

The third database 1003*a* is a database having stored therein correspondency relationship between various possible vertical positions of the damper pedal rod 116 and various possible vertical positions of the dampers 6. Note that the third database 1003*a* is different from the aforementioned third database 1003 in that the vertical positions stored in the third database 1003*a* are physical amounts in mm.

The fourth database 1004*a* is a database having stored therein correspondency relationship between various possible vertical positions of the lifting rail 8 and various possible vertical positions of the dampers 6. Note that the fourth database 1004*a* is different from the aforementioned fourth database 1004 in that the vertical positions stored in the fourth database 1004*a* are physical amounts in mm.

Once the second conversion section 1011 extracts a MIDI value from among sequentially-acquired performance data, the second conversion section 1011 references the second database 1002*a* to acquire a value in mm, i.e. vertical position of the damper pedal rod 116, associated with (corresponding to) the extracted MIDI value. Then, the second conversion section 1011 references the third database 1003*a* to acquire a value in mm, i.e. a vertical position of the dampers 6, associated with the acquired vertical position of the damper pedal rod 116, after which the second conversion section 1011 acquires, from the fourth database 1004*a*, a value in mm, i.e. a vertical position of the lifting rail 8, associated with the acquired vertical position of the dampers 6. Then, the second conversion section 1011 outputs the acquired vertical position of the lifting rail 8 to the second buffer 1013 as a position instruction value rx. Because the position instruction value stored in the second buffer 1013 is a physical amount in mm, the position instruction value rx output from the management section 1030 too is a physical amount in mm, and the velocity instruction value ry output from the management section 1030 is a physical amount in the unit of minis.

Further, the first conversion section 1021 references the first database 1001*a* to acquire a value in mm, i.e. a vertical position of the damper pedal rod 116, associated with the position value yx stored in the first buffer 1023. Then, the first conversion section 1021 references the second database 1002*a* to acquire a MUM value associated with the extracted vertical position of the damper pedal rod 116. Namely, by referencing the first and second databases 1001*a* and 1002*a*, the first conversion section 1021 converts the position value yx, which is a physical amount in mm, into a dimensionless MIDI value. Then, the second conversion section 1021 outputs performance data of the MIDI format including the acquired MIDI value, and such performance data output from the second conversion section 1021 becomes a control change message pertaining to the driving of the dampers 6.

The second embodiment is different from the first embodiment in that, whereas the position value yx, position instruction value rx, velocity value yv and velocity instruction value ry are dimensionless values in the first embodiment, such values are physical amounts in mm or minis in the second embodiment. Note that behavior of the servo control in the second embodiment is the same as in the first embodiment and thus will not be described here to avoid unnecessary duplication.

[Third Embodiment]

The following describe a third embodiment of the player piano 100 of the present invention. The third embodiment has, in addition to the functions of the first embodiment, a function for operating the soft pedal 112 on the basis of performance data, and a function for generating performance data representative of user's operation of the soft pedal 112. Namely, the third embodiment is constructed to apply the basic principles of the present invention to the soft pedal 112 as well as the damper pedal 110. Namely, the basic principles of the present invention are applicable in association with not only the damper pedal but also any other desired pedal employed in a musical instrument.

Figure 12:
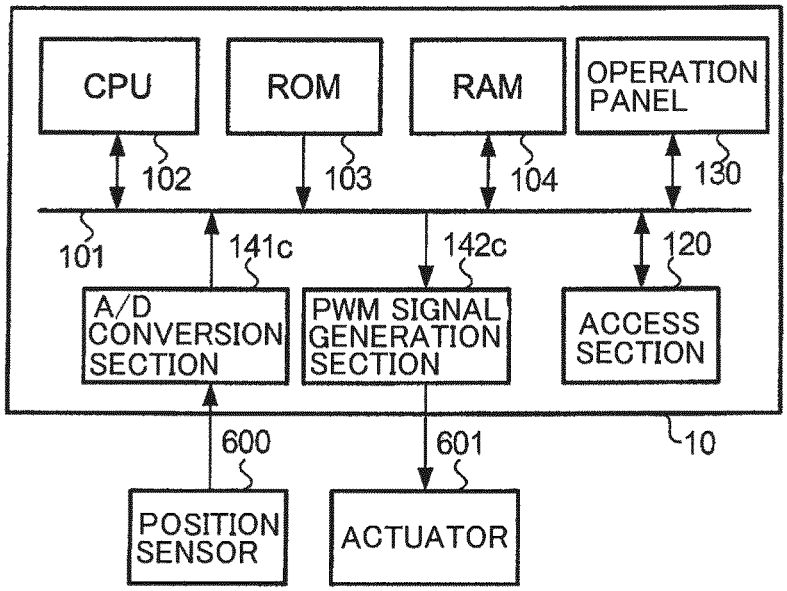
FIG. 12 is a schematic block diagram showing an example construction of electric/electronic circuitry in a third embodiment of the player piano of the present invention.
Figure 13:
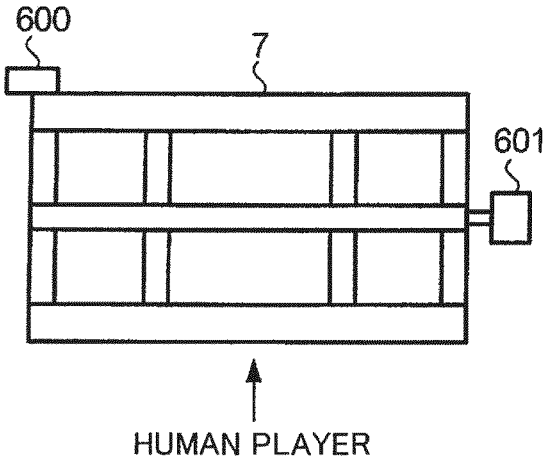
FIG. 13 is a diagram showing example positional relationship among a key frame, a position sensor and an actuator in the third embodiment of the player piano.

FIG. 12 is a schematic block diagram showing an example construction of the controller 10 in the third embodiment of the player piano 100, and FIG. 13 is a schematic top plan view of a keyframe (driven member) 7 on which are placed the keys 1 and the hammer action mechanisms 3. As the keyframe 7 moves, the hammer action mechanisms 3 placed on the reed 7 too move, so that a relative position of the hammers 2 to the strings 4 varies. Note that illustration of the constructions related to the driving of the keys 1 and the damper pedal 110 is omitted in FIG. 12.

In FIG. 13, a position sensor 600 is provided for detecting a position of the keyframe 7 moved or displaced in response to user's (human player's) operation of the soft pedal 112. As shown in FIG. 13, the position sensor 600 is provided on an end portion of the keyframe 7 where low-pitch keys 1 are disposed, and it detects a position, in the left-right direction as viewed from the human player, of the keyframe 7. An actuator (drive section) 601 is connected to an end portion, in the left-right direction, of the keyframe 7 where high-pitch keys 1 are disposed, and it moves the keyframe 7 in the left-right direction.

An A/D conversion section 141*c* converts an analog signal output from the position sensor 600 to a digital signal yd and outputs the converted digital signal to a motion controller 1000*c*. The analog signal output from the position sensor 600 is indicative of a position, in the left-right direction, of the keyframe 7 (hereinafter referred to as "left-right position of the keyframe 7"), and thus, the converted digital signal too is indicative of the left-right position of the keyframe 7.

Figure 14:
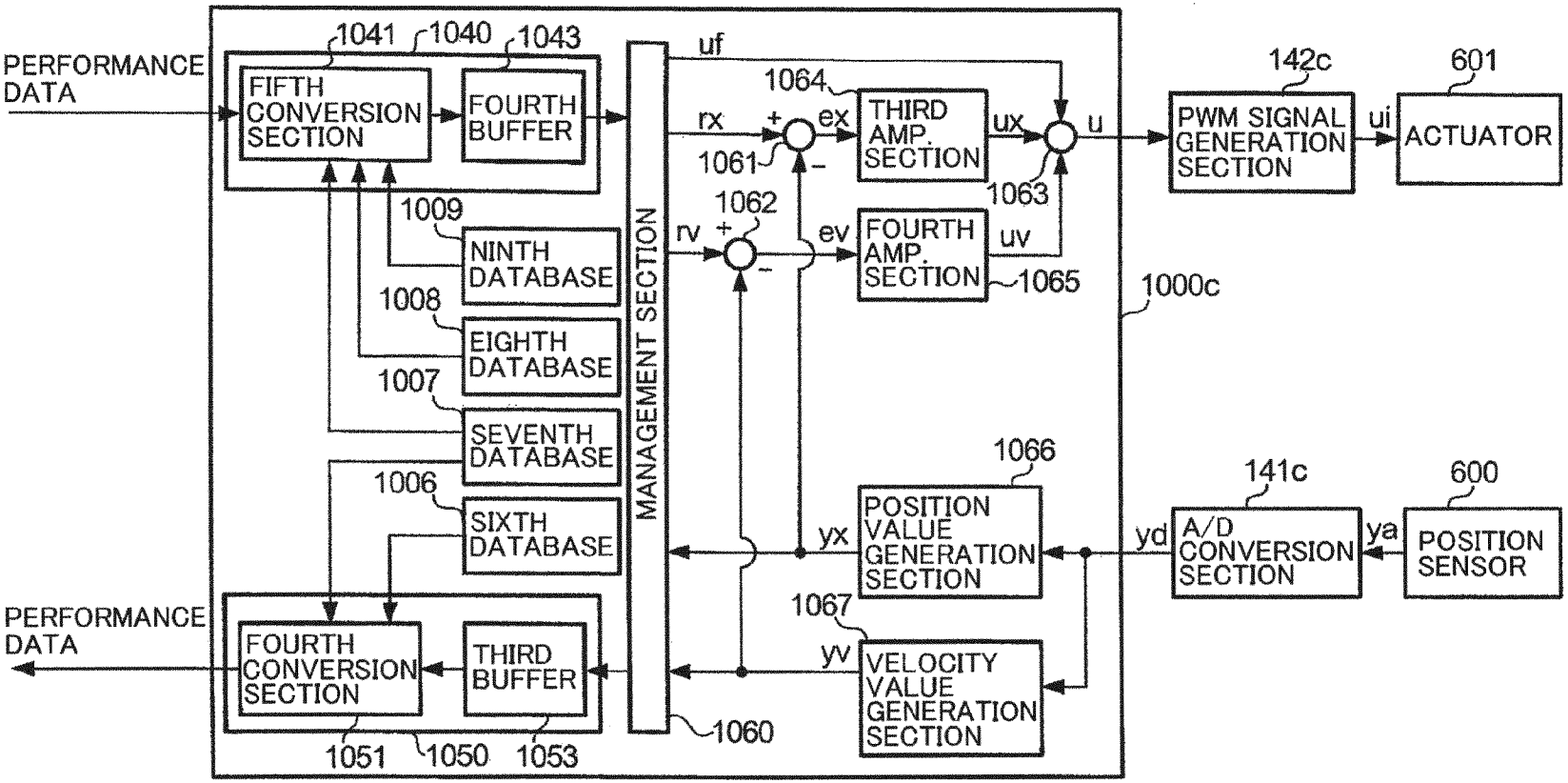
FIG. 14 is a schematic block diagram showing example functional arrangements of a motion controller in the third embodiment of the player piano.

FIG. 14 is a schematic block diagram showing an example construction of the motion controller (control section) 1000*c* implemented by the CPU 102. The motion controller 1000*c* has a function for driving the keyframe 7 on the basis of performance data, and a function for generating performance data representative of user's operation of the keyframe 7.

In FIG. 14, a position value generation section 1066 performs a smoothing process on the digital signal yd output from the A/D conversion section 141*c*, and it outputs a value, obtained through the smoothing process, as a position value yx indicative of a left-right position of the keyframe 7.

A velocity value generation section 1037 generates a velocity value yv indicative of a moving velocity of the keyframe 7. More specifically, the velocity value generation section 1067 calculates a moving velocity of the keyframe 7 by performing a temporal differentiation process on sequentially supplied digital signals yd and outputs a velocity value yv indicative of the moving velocity of the keyframe 7.

Further, in FIG. 7, a sixth database 1006 has prestored therein correspondency relationship between various possible left-right positions of the keyframe 7 and various possible vertical positions of a pedal rod (hereinafter referred to as "soft pedal rod") connected to the soft pedal 112 (and hence various possible vertical positions of a rear end portion of the soft pedal 112). As the soft pedal 112 is operated, the soft pedal rod moves upward or ascends, in response to which the keyframe 7 is displaced rightward as viewed from the human player. Thus, the correspondency relationship between various possible left-right positions of the keyframe 7 and various possible vertical positions of the soft pedal rod is set such that an amount of the rightward displacement of the keyframe 7 increases as the position of the soft pedal rod rises. Because the six database 1006 has prestored therein, per position of the soft pedal rod, a left-right position of the keyframe 7 in association with the position of the soft pedal rod, it is possible to obtain a position of the soft pedal rod on the basis of a position of the keyframe 7 by reference to the sixth database 1006.

A seventh database 1007 is a database having prestored therein correspondency relationship between various values of control change messages of the soft pedal can take in performance data of the MIDI format (hereinafter referred to as "MIDI values") and various possible vertical positions of the soft pedal rod connected to the soft pedal 112. Namely, the seventh database 1007 has prestored therein MIDI values obtained by normalizing vertical positions of the soft pedal rod. Because a variation in vertical position of the soft pedal rod corresponds to a variation in vertical position of a rear end portion of the soft pedal 112, it can be said that a vertical position of the soft pedal rod represents a vertical position of the rear end portion of the soft pedal 112. Namely, the seventh database 1007 has prestored therein, per vertical position of the soft pedal rod, a MIDI value in association with the vertical position of the soft pedal rod. For example, in the seventh database 1007. MIDI value "0" indicating that a mute function is currently OFF (i.e., the hammers 2 are in their initial position) is associated with the lowest position of the soft pedal rod (i.e., non-operated position of the soft pedal 112). MIDI value "64" is associated with a vertical position of the soft pedal rod when the soft pedal 112 is in a half-depressed or half-pedal position, and MIDI value "127" is associated with the highest vertical position of the soft pedal rod (i.e., position of the soft pedal rod when the hammers 2 have moved the greatest distance from the initial position).

Further, in FIG. 14, an eighth database 1008 is a database having prestored therein correspondency relationship between various possible vertical positions of the soft pedal rod connected to the soft pedal 112 and various possible positions, in the left-right direction, of the hammers 2 (hereinafter referred to as "left-right positions of the hammers 2"). In the player piano having the soft pedal, as the soft pedal rod connected to the soft pedal 112 moves upward or ascends, a relative position of the hammers 2 to the strings 4 varies. Thus, the correspondency relationship between various possible vertical positions of the soft pedal rod connected to the soft pedal 112 and various possible left-right direction positions of the hammers 2 is set such that the hammers 2 move rightward relative to the strings 4 as the position of the soft pedal rod rises. Namely, the eighth database 1008 has prestored therein, per vertical position of the soft pedal rod, a left-right position of the hammers 2 in association with the vertical position of the soft pedal rod. Thus, by referencing the eighth database 1008, it is possible to obtain a position of the hammers 2 on the basis of a vertical position of the soft pedal rod.

Further, in FIG. 14, a ninth database 1009 is a database having prestored therein correspondency relationship between various possible left-right positions of the hammers 2 and various possible left-right positions of the keyframe 7. As the keyframe 7 is moved in response to user's operation of the soft pedal 112, the hammers 2 placed on the keyframe 7 move. Thus, the correspondency relationship between various possible left-right positions of the hammers 2 and various possible left-right positions of the keyframe 7 is set such that, as the amount of rightward displacement of the keyframe 7 increases, an amount of rightward displacement of the hammers 2 increases. Because the ninth database 1009 has prestored therein correspondency relationship between various possible left-right positions of the hammers 2 and various possible left-right positions of the keyframe 7 as noted above, it is possible to obtain a left-right position of the keyframe 7 on the basis of a position of the hammers 2 by reference to the ninth database 1009.

Further, in FIG. 14, a soft pedal performance data generation section 1050 comprises a fourth conversion section 1051 and a third buffer 1053. The third buffer 1053 is a buffer for acquiring and storing position values yx output from the position generation section 1066 to a management section 1060. As the soft pedal 112 is operated by the user, the left-right position of the keyframe 7 varies with the passage of time. If the soft pedal 112 is in the non-operated position at time point t1, in the half-pedal (half-depressed) position at time point t2 and in the fully-depressed position, at time point t3, respective position values yx at these time points t1 to t3 are stored into the third buffer 1053 in the order of the time points.

The fourth conversion section 1051 references the sixth database 1006 to acquire a vertical position of the soft pedal rod associated with the position value yx stored in the third buffer 1053. Further, the fourth conversion section 1051 references the seventh database 1007 to acquire a MIDI value associated with the vertical position of the soft pedal rod acquired from the sixth database 1006. Namely, by referencing the sixth and seventh databases 1006 and 1007, the fourth conversion section 1051 converts the position value yx into a dimensionless MIDI value. Then, the fourth conversion section 1051 outputs performance data of the MIDI format including the acquired MIDI value. Such performance data output from the fourth conversion section 1051 becomes a control change message pertaining to the soft pedal 112.

Further, in FIG. 14, a soft pedal performance data analysis section 1040 comprises a fifth conversion section 1041 and a fourth buffer 1043. The fifth conversion section 1041 acquires performance data of the MIDI format read out from a recording medium by the access section 120. The performance data acquired by the fifth conversion section 1041 is a control change message that is related to the soft pedal. The fifth conversion section 1051 extracts a MIDI value included in the performance data. Once the fifth conversion section 1041 extracts a MIDI value from sequentially-supplied performance data, it first references the seventh database 1007 to acquire a value associated with the extracted MIDI value, i.e. acquire a vertical position of the soft pedal rod connected to the soft pedal 112. Then, the fifth conversion section 1041 references the eighth database 1008 to acquire a left-right position of the hammers 6 corresponding to the vertical position of the soft pedal rod acquired from the seventh database 1007. Then, the fifth conversion section 1041 references the ninth database 1009 to acquire a left-right position of the keyframe 7 corresponding to the left-right position of the hammers 2 acquired from the eighth database 1008 and outputs the thus-acquired value (left-right position of the keyframe 7) to the fourth buffer 1043 as a position instruction value rx.

The fourth buffer 1043 is a buffer for temporarily storing the position instruction value rx. For example, if the MIDI value differs among the sequentially-supplied performance data, and if the MIDI value at time point t1 is "0", the MIDI value at time point t2 is "64" and the MIDI value at time point t3 is "127", then a set of time point t1 and the position instruction value rx at time point t1, a set of time point t2 and the position instruction value rx at time point t2 and a set of time point t3 and the position instruction value rx at time point t3 arc sequentially stored into the fourth buffer 1043 in the order of the time points.

The management section 1060 acquires the time points and position instruction values rx stored in the fourth buffer 1043 and outputs the acquired position instruction values rx. Further, the management section 1060 acquires the sets of time points and position instruction values rx stored in the fourth buffer 1043 to perform a temporal differentiation process on the acquired sets of time points and position instruction values rx to thereby calculate a moving velocity of the keyframe 7 and outputs a velocity instruction value ry indicative of the moving velocity of the keyframe 7. Also, the management section 1060 outputs a predetermined fixed value uf.

Furthermore, in FIG. 14, a third subtractor 1061 acquires the position instruction value rx output from the management section 1060 and the position value yx output from the position value generation section 1066. Then, the third subtractor 1061 performs an arithmetic operation of "position instruction value rx−position value yx" and outputs a position deviation ex, which is a result of the arithmetic operation, to a third amplification section 1064.

A fourth subtractor 1062 acquires the velocity instruction value ry output from the management section 1060 and the velocity value yv output from the velocity value generation section 1067. Then, the fourth subtractor 1062 performs an arithmetic operation of "velocity instruction value ry−velocity value yv" and outputs a velocity deviation ev, which is a result of the arithmetic operation, to a fourth amplification section 1065.

The third amplification section 1064 acquires the position deviation ex and multiplies the acquired position deviation ex by a predetermined amplification factor and outputs a result of the multiplication as a position control value ux. Namely, here, the third amplification section 1064 performs unit conversion for converting a position-component control amount represented by the position deviation ex into a value corresponding to a duty ratio to be used in a PWM signal generation section 142*c* provided at the following stage.

The fourth amplification section 1065 acquires the velocity deviation ev and multiplies the acquired velocity deviation ev by a predetermined amplification factor and outputs a result of the multiplication as a velocity control value uv. Namely, here, the fourth amplification section 1065 performs unit conversion for converting a velocity-component control amount represented by the velocity deviation ev into a value corresponding to a duty ratio to be used in the PWM signal generation section 142*c*.

Furthermore, in FIG. 14, an adder 1063 adds together the fixed value uf, position control value ux and velocity control value uv and outputs a result of the addition (i.e., sum) of these values as a control value u. The control value u is a value indicative of an electric current to be supplied to the actuator 601 (in other words, a duty ratio to be used in the PWM signal generation section 142*c*).

The PWM signal generation section 142*c* outputs a PWM signal for driving the actuator 601. More specifically, the. PWM signal generation section 142*c* generates a PWM signal ui corresponding to the above-mentioned control value u and outputs the thus-generated PWM signal ui to the actuator 601, so that the actuator 601 having received the PWM signal ui displaces the key frame 7 in accordance with the PWM signal

[Behavior of the Third Embodiment]

[Behavior When User's Performance is to be Stored as Performance Data]

If the user performs, on the operation panel 130, operation for instructing storage of performance data, performance data representative of a performance executed by the user will be recorded into a recording medium inserted in the access section 120. For example, as the user steps on or depresses a front end portion of the soft pedal 120, a rear end portion of the soft pedal 112 moves upward, causing the soft pedal rod to move upward. By the upward movement of the soft pedal rod, the keyframe 7 moves so that the hammers 2 move relative to the strings 4.

As the left-right position of the keyframe 7 varies in the aforementioned manner, the analog signal ya output from the position sensor 600 varies. Such an analog signals ya is sampled and sequentially converted into digital signals yd by the A/D conversion section 141*c*. The digital signals yd obtained by the A/D conversion section 141*c* are sequentially output to the position value generation section 1066. The position value generation section 1066 performs the smoothing process on the sequentially-supplied digital signals yd and thereby outputs a position value yx indicative of a position of the keyframe 7. Because the position of the keyframe 7 varies in response to the operation of the soft pedal 112, such a position value yx too varies in response to the operation of the soft pedal 112.

The position value yx output from the position value generation section 1066 is supplied via the management section 1060 to the third buffer 1053 for storage therein. The fourth conversion section 1051 acquires, from the sixth database 1006, a vertical position of the soft pedal rod associated with the position value yx stored in the third buffer 1053 and acquires, from the seventh database 1007, a MIDI value associated with the vertical position of the soft pedal rod acquired from the sixth database 1006. Once the fourth conversion section 1051 acquires the MIDI value, it outputs performance data of the MIDI format including the acquired MIDI value. Such performance data output from the fourth conversion section 1051 becomes a control change message pertaining to the soft pedal 112. The CPU 102 controls the access section 120 to store, into the recording medium, the performance data together with information indicative of a performance time.

[Behavior when Performance Data of the Soft Pedal are Reproduced]

The following describe behavior of the piano 100 when the keyframe 7 is to be driven on the basis of performance data stored in a recording medium. First, once a recording medium having stored therein performance data of the MEN format is inserted into the access section 120 and user's operation for reproducing the performance data from the recording medium is performed on the operation panel 130, the CPU 102 reads out the performance data from the recording medium. If, at that time, a control change message pertaining to the soft pedal 112 is read out as the performance data, that performance data is supplied to the fifth conversion section 1041.

Once the fifth conversion section 1041 extracts a MIDI value from the acquired performance data, it references the seventh database 1007 to acquire a vertical position of the soft pedal rod associated with the extracted MIDI value. Then, the fifth conversion section 1041 references the eighth database 1008 to acquire a left-right position of the hammers 2 associated with the acquired vertical position of the soft pedal rod. Then, the fifth conversion section 1041 acquires, from the ninth database 1009, a left-right position of the keyframe 7 associated with the acquired left-right position of the hammers 2. After that, the fifth conversion section 1041 outputs the acquired left-right position of the keyframe 7 to the fourth buffer 1043 as a position instruction value rx. For example, if the MIDI value at time point t1 is "0", the MIDI value at time point t2 is "64" and the MIDI value at time point t3 is "127", then a set of time point ti and the position instruction value rx at time point t1, a set of time point t2 and the position instruction value rx at time point t2 and a set of time point t3 and the position instruction value rx at time point t3 are sequentially stored into the fourth buffer 1043 in the order of the time points.

The management section 1060 acquires the time points and position instruction values rx stored in the fourth buffer 1043 and outputs the acquired position instruction values rx. Further, the management section 1060 sequentially acquires the sets of time points and position instruction values rx stored in the fourth buffer 1043 to perform a temporal differentiation process on the acquired sets of time points and position instruction values rx to thereby calculate a moving velocity of the keyframe 7 and outputs a velocity instruction value ry indicative of the moving velocity of the keyframe 7.

An analog signal ya indicative of a left-right position of the keyframe 7 is output from the position sensor 600, and such an analog signal ya is sequentially converted into digital signals yd by the A/D conversion section 141*c*. The position value generation section 1066 outputs, on the basis of the digital signals yd, a position value yx indicative of a position of the keyframe 7, and the velocity value generation section 1067 performs a temporal differentiation process on the digital signals yd to calculate a moving velocity of the keyframe 7 and outputs a velocity value yv indicative of the moving velocity of the keyframe 7.

The third subtractor 1061 acquires the position instruction value rx output from the management section 1060 and the position value yx output from the position value generation section 1066 and performs an arithmetic operation of "position instruction value rx−position value yx" to thereby output a position deviation ex, which is a result of the arithmetic operation, to the third amplification section 1064. The fourth subtractor 1062 acquires the velocity instruction value ry output from the management section 1060 and the velocity value yv output from the velocity value generation section 1067. The fourth subtractor 1062 performs an arithmetic operation of "velocity instruction value ry−velocity value yv" to thereby output a velocity deviation ev, which is a result of the arithmetic operation, to the fourth amplification section 1065.

The third amplification section 1064 acquires the position deviation ex and multiplies the acquired position deviation ex by a predetermined amplification factor and outputs a result of the multiplication as a position control value ux. Further, the fourth amplification section 1065 acquires the velocity deviation ev and multiplies the acquired velocity deviation ev by a predetermined amplification factor and outputs a result of the multiplication as a velocity control value uv. The adder 1063 adds together the fixed value uf, position control value ux and velocity control value uv and outputs a result of the addition (i.e., sum) of these values as a control value u to the. PWM signal generation section 142*c*. The PWM signal generation section 142*c* outputs a PWM signal ui corresponding to the above-mentioned control value u and outputs the thus-generated PWM signal ui to the actuator 601, so that the actuator 601 displaces the keyframe 7 in accordance with the PWM signal ui.

As the keyframe 7 is displaced, the analog signal ya output from the position sensor 600 varies. This analog signal ya is converted into a digital signal yd and output to the position value generation section 1066 and the velocity value generation section 1067. The position value yx is fed back to the third subtractor 1061 and the velocity value yv is fed back to the fourth subtractor 1062, so that a control value u is output such that the position deviation ex and the velocity deviation ev decrease.

In the motion controller 1000*b* in the instant embodiment too, the digital signal yd may be may he converted into a value in the unit of mm by a conversion section and a database, and arithmetic operations pertaining to the feedback control may be performed in the unit of mm, as in the motion controller 1000*b* in the above-described second embodiment. Further, values of positions may be handled in mm in the sixth to ninth databases 1006 to 1009.

[Modifications]

Whereas the present invention has been described above in relation to various embodiments, the present invention is not limited to the above-described embodiments, and such embodiments may be modified as follows. The above-described embodiments and modifications to be described below may also be combined as necessary.

The first and second embodiments have been described above as constructed to acquire a position of the damper pedal rod 116 from a MIDI value, acquire a position of the dampers 6 from the position of the damper pedal rod 116 and acquire a position of the lifting rail 8 from the position of the dampers 6. Alternatively, there may be provided another database having stored therein correspondency relationship between various possible positions of the damper pedal rod 116 and various possible positions of the lifting rail 8, so that after a position of the damper pedal rod 116 is acquired by reference to the second database 1002, a position of the lifting rail 8 can be acquired from the position of the damper pedal rod 116 by reference to the other database.

In the third embodiment too, there may be provided another database having stored therein correspondency relationship between various possible positions of the damper pedal rod 116 and various possible positions of the keyframe 7, so that, after a position of the soft pedal rod connected to the soft pedal 112 is acquired by reference to the seventh database 1007, a position of the keyframe 7 can be acquired from the position of the soft pedal rod by reference to the other database.

Whereas, in the above-described embodiments, the position sensor 555 is constructed to detect a vertical position of a right end portion (as viewed from the human player) of opposite longitudinal end portions of the lifting rail 8, the position sensor 555 mat detect a vertical position of a left end portion (as viewed from the human player) of the lifting rail 8. Alternatively, such position sensors 555 may be provided on both of the opposite longitudinal end portions of the lifting rail 8 for detecting vertical positions of the opposite end portions of the lifting rail 8. In such a case, the position value generation section 1036 may calculate an average value of digital signals yd obtained by digital conversion of analog signals output from the two position sensors 555 and determine a position value yx based on the calculated average value. Alternatively, the position sensor 555 may be provided on a longitudinally middle portion of the lifting rail 8. As another alternative, the position sensor 555 may be provided on middle and left end portions, or middle and right end portions, or middle, left and right end portions of the lifting rail 8. Further, in the case where a plurality of the position sensors 555 are provided, the number of the position sensors 555 is not limited to two or three, and four or more position sensors 555 may be provided on not only opposite longitudinal end portions and middle portion of the lifting rail 8 but also one or more other portions of the lifting rail 8. Further, instead of the position sensor 555 being disposed on the frame 551, the light-permeable plate 555*a* of the position sensor 555 may be disposed on the upper surface of the lifting rail 8 and the detection section 555*b* of the position sensor 555 may be disposed over the lifting rail 8.

Further, whereas, in the above-described embodiments, the position sensor is constructed to detect a position by use of light, the present invention is not so limited, and the position sensor may be constructed to detect a position by use of a linear potentiometer detecting a linear position, or by use of magnetism, or otherwise.

Furthermore, in the above-described embodiments, where the position sensor 555 is constructed to detect a vertical position of the lifting rail 8, the transparent or light-permeable plate 555*a* of the position sensor 555 may be provided on the outer peripheral surface of the lifting rod 115 along the longitudinal direction of the lifting rod 115 in such a manner that a vertical position of the lifting rod 115 can be detected by the light-permeable plate 555*a* passing between the light emitting portion and the light receiving portion of the position sensor 555. Because the lifting rod 115 is displaced together with the lifting rail 8, it may be said that this modified arrangement indirectly detects a position of the lifting rail 8, although the modified arrangement actually detects a position of the lifting rod 115.

Furthermore, whereas the above-described embodiments are constructed in such a manner that performance data output from the individual motion controllers are stored into a recording medium inserted in the access section 120, an interface for performing communication with another external device may be provided in the controller 10 in such a manner that performance data can be output to the other external device via the interface. Further, in such a case, performance data may be acquired from the other external device via the interface and supplied to the individual motion controllers.

Figure 15:
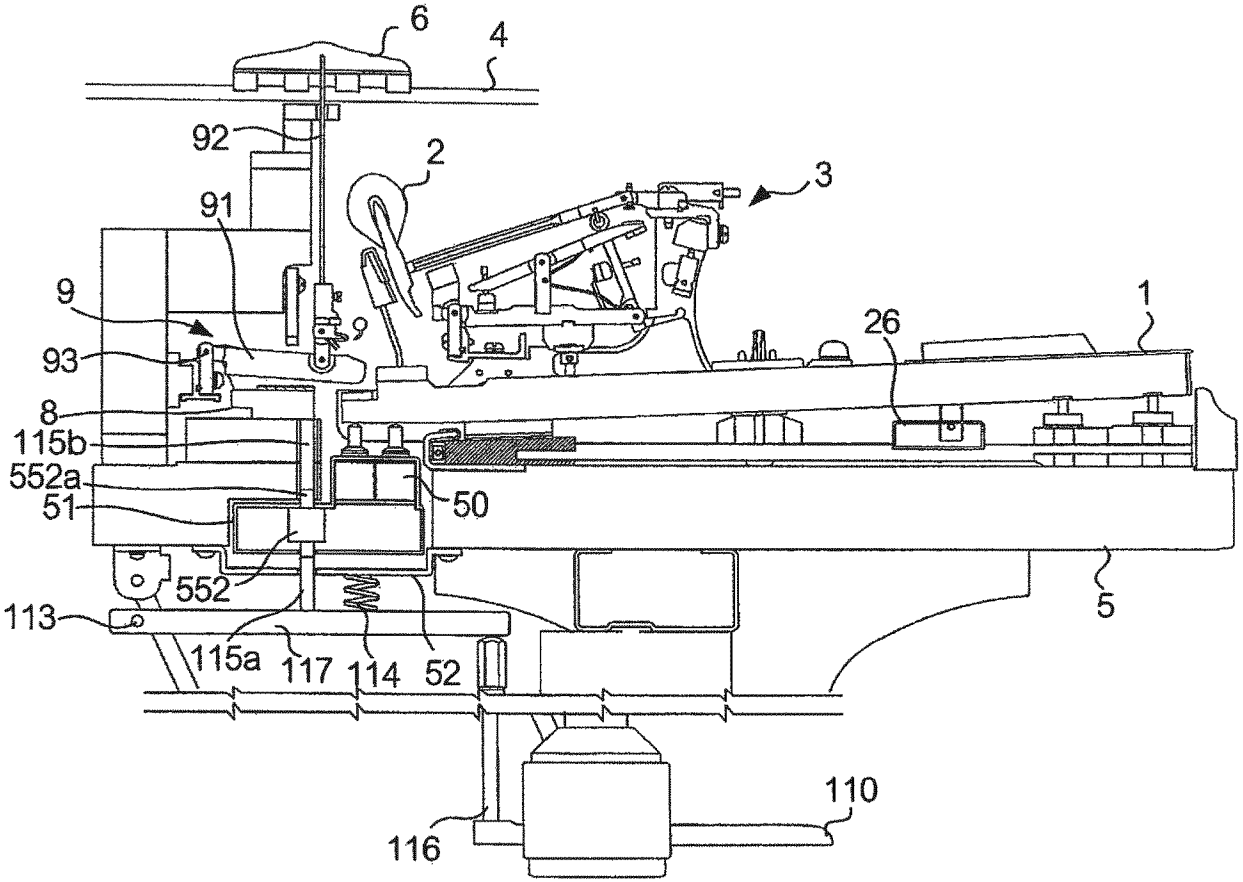
FIG. 15 is a view showing an example inner construction of the player piano employing a modification of the actuator.

Whereas, in the above-described embodiments, the lifting rail (driven member) 8 is driven by the solenoid 552 via the connection member 550, the construction for driving the lifting rail (driven member) 8 is not so limited. FIG. 15 is a view showing an example inner construction of the grand piano 100 equipped with an automatic performance function according to a modification of the present invention. In the instant modification, the solenoid 552 is disposed within the case 51, and the grand piano 100 includes two vertically divided, i.e. upper and lower, lifting rods 115*b* and 115*a*. The lower lifting rod 115*a* has a lower end contacting the upper surface of the damper pedal lever 117, and an upper end contacting the lower end of the plunger 552*a* of the solenoid 552. Further, the upper lifting rod 115*b* has a lower end contacting the upper end of the plunger 552*a* of the solenoid 552, and an upper end contacting the lower surface of the lifting rail 8. The upper lifting rod 115*b* functions as a transmission means for transmitting linear motion of the solenoid 552 to the lifting rail 8.

In the construction of FIG. 15, as the damper pedal 110 is stepped on or depressed by the human player, the damper pedal lever 117 pushes upward the lower lifting rod 115*a* so that the plunger 552*a* is pushed upward by the lower lifting rod 115*a*. Thus, the plunger 552*a* pushes upward the upper lifting rod 115*b* so that the lifting rail 8 is pushed upward by the upper lifting rod 115*b*. Because the solenoid 552 is not energized in this case, the plunger 552*a* is freely movable in the up-down direction in response to the depressing operation of the damper pedal 110.

Once the solenoid 552 is driven (or energized), the plunger 552*a* moves upward to push upward the upper lifting rod 115*b*, which in turn pushes upward the lifting rail 8. When the lifting rail 8 is driven via the solenoid 552 like this, the driving force of the solenoid 552 does not act on the spring 114. Thus, with this modification too, the dampers 6 can be moved without requiring a great force.

Namely, in the modified construction of FIG. 15, the actuator (solenoid) 552 is disposed halfway on the lifting rod 115 (between the upper and lower lifting rods 115*b* and 115*a*) movable in the up-down direction for transmitting motion of the user-operated damper pedal 110 to the lifting rail (driven member) 8, and the lifting rod 115 (115*b*) is moved in response to upward motion of the actuator (solenoid) 552 and thereby displaces upward the lifting rail (driven member) 8.

Figure 16:
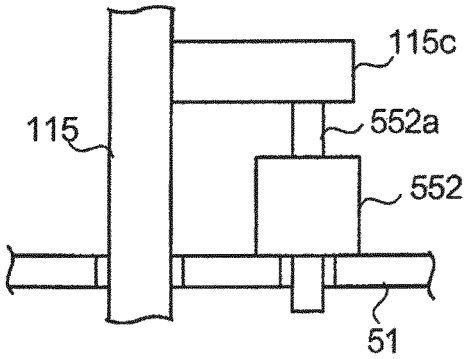
FIG. 16 is a diagram showing another modification of the actuator.

Further, in the case where the solenoid for driving the lifting rail 8 is accommodated within the case 51, a modified construction of FIG. 16 may be employed. FIG. 16 is a schematic view showing in enlarged scale the interior of the case 51 from the front. In the instant modification, the lifting rod 115 has a rod (transmission rod) 115*c* connected thereto and projecting laterally to contact the plunger 552*a* of the solenoid 552 accommodated within the case 51. If the solenoid 552 is driven, the plunger 552*a* moves upward to push the rod 115*c* upward. As the rod 115*c* is pushed upward like this, the lifting rod 115 connected with the rod 115*c* is pushed upward, so that the lifting rail 8 is pushed upward. With this modification too, the dampers 6 can be moved without requiring a great force because the driving force of the solenoid 552 does not act on the spring 114.

Namely, in the construction of FIG. 16, the actuator (solenoid) 552 is disposed beside the lifting rod 115 that is movable in the up-down direction for transmitting motion of the user-operated damper pedal 110 to the lifting rail (driven member) 8, and motion of the actuator (solenoid) 552 is transmitted to the lifting rod 115 (115*b*) via a transmission member (rod 115*c*) so that the lifting rail (driven member) 8 is displaced.

Figure 17:
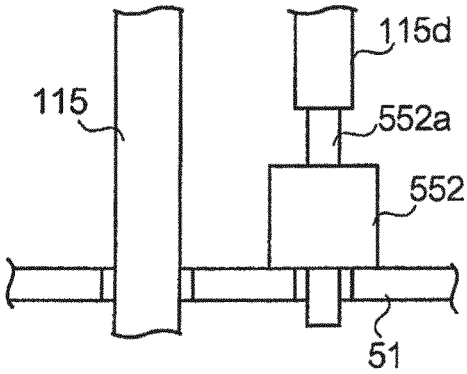
FIG. 17 is a diagram showing still another modification of the actuator.

Further, in the player piano 100, another or second lifting rod (or transmission rod) separate from the lifting rod 115 may be provided, and this second lifting rod may be driven by the solenoid 552 without the lifting rod 115 being driven by the solenoid 552. FIG. 17 is a schematic diagram showing such a modified construction including the second lifting rod 115*d*. The plunger 552*a* of the solenoid 552 disposed within the case 51 is held in contact with the second lifting rod 115*d* that extends through the case 51 and the keybed 5 to contact the underside of the lifting rail 8. With this modification too, the dampers 6 can be moved without requiring a great force because the driving force 552 does not act on the spring 114.

Namely, in the construction of FIG. 17, the actuator (solenoid) 552 is disposed beneath the lifting rail (driven member) 8, and the transmission rod (second lifting rod) 115*d* is provided between the actuator (solenoid) 552 and the lifting rail (driven member) 8 so that motion of the actuator (solenoid) 552 is transmitted to the lifting rail (driven member) 8 via the transmission rod (second lifting rod) 115*d*.

In the case where the second lifting rod (transmission rod) 115*d* is provided like this, the second lifting rod 115*d* may extend through the case 51 and the cover 52, and the solenoid 552 may be disposed underneath the cover 52 so that the second lifting rod 115*d* is driven by the solenoid 552. Further, in the construction where the second lifting rod 115*d* extending through the case 51 and the cover 52 is driven by the solenoid 552, a lever contacting the lower end of the lifting rod 115*d* and pivotable about a pin may be provided to be driven by the solenoid.

Whereas the above-described embodiments and modifications are constructed to drive the lifting rail 8 or the lifting rod 115 by means of the solenoid, the actuator for driving the lifting rail 8 or lifting rod 115 is not limited to a linear actuator, such as a solenoid. For example, rotary motion of a rotary actuator, such as a motor, may be converted into linear motion so that the lifting rail 8 or the lifting rod 115 is driven by such converted linear motion.

Whereas the above-described embodiments are constructed to perform servo control using a velocity instruction value and a velocity value, the present invention may be constructed to perform the servo control using a position instruction value and a position value rather than a velocity instruction value and a velocity value.

Furthermore, whereas the embodiments have been described above as applied to a grand piano as a musical instrument provided with damper mechanisms, the present invention is also applicable to an upright piano. Alternatively, the present invention may be applied to other musical instruments than pianos, such as a celesta and glockenspiel, having sounding members; in such a case too, motions of the dampers may be stored as performance data so that the dampers are driven on the basis of the performance data, as in the above-described embodiments of the piano.

This application is based on, and claims priority to, Japanese patent application No. 2012-008404 filed on 18 Jan. 2012. The disclosure of the priority application, in its entirety, including the drawings, claims, and the specification thereof, are incorporated herein by reference.

What is claimed is:

1. A musical instrument comprising:

a pedal configured to be displaceable in response to user's operation;

a driven member configured to be displaceable in interlocked relation to displacement of said pedal;

a control member configured to vary in its position relative to a sounding member, in response to displacement of said driven member, to thereby control the sounding member;

a drive section configured to drive said driven member;

a sensor configured to detect a position of said driven member;

a first database storing therein correspondency relationship between positions of said pedal and positions of said driven member;

a second database storing therein correspondency relationship between the positions of said pedal and control values; and a first output section configured to:

acquire, from said first database, a position of said pedal corresponding to a position of said driven member detected by said sensor;

acquire, from said second database, a control value corresponding to the acquired position of said pedal; and output the acquired control value as pedal operation information.

2. The musical instrument as claimed in claim 1, comprising:

a third database storing therein correspondency relationship between the positions of said pedal and positions of said control member;

a fourth database storing therein correspondency relationship between the positions of said control member and the positions of said driven member;

a second output section configured to:

acquire, from said second database, a position of said pedal corresponding to an input control value; acquire, from said third database, a position of said control member corresponding to the acquired position of said pedal;

acquire, from said fourth database, a position of said driven member corresponding to the acquired position of said control member; and output, as an instructed position, the position of said driven member acquired from said fourth database; and a control section configured to control said drive section to position said driven member at the instructed position output by said second output section.

3. The musical instrument as claimed in claim 1, wherein the control value output by said first output section is recorded into a recording medium.

4. The musical instrument as claimed in claim 2, wherein the control value recorded in the recording medium is input to said second output section.

5. The musical instrument as claimed in claim 2, wherein:

said third database stores therein a first virtual position of said control member in association with a position of said pedal in a range where said control member is not displaced even when said pedal is displaced, and said fourth database stores therein a second virtual position of said control member in association with a position of said driven member in a range where said control member is not displaced even when said driven member is displaced.

6. The musical instrument as claimed in claim 1, wherein the control values stored in said second database are each a value obtained by normalizing a position of said pedal.

7. The musical instrument as claimed in claim 1, said pedal is a damper pedal, and said control member is a damper for damping vibration of the sounding member.

8. A musical instrument comprising:

a pedal configured to be displaceable in response to user's operation;

a driven member configured to be displaceable in interlocked relation to displacement of said pedal;

a control member configured to vary in its position relative to a sounding member, in response to displacement of said driven member, to thereby control the sounding member;

a drive section configured to drive said driven member;

a sensor configured to detect a position of said driven member;

a first database storing therein correspondency relationship between positions of said pedal and control values;

a second database storing therein correspondency relationship between the positions of said pedal and positions of said control member;

a third database storing therein correspondency relationship between the positions of said control member and positions of said driven member;

an output section configured to:

acquire, from said first database, a position of said pedal corresponding to an input control value;

acquire, from said second database, a position of said control member corresponding to the acquired position of said pedal;

acquire, from said third database, a position of said driven member corresponding to the acquired position of said control member; and output, as an instructed position, the position of said driven member acquired from said third database; and a control section configured to control said drive section to position said driven member at the instructed position output by said output section.

9. A method of obtaining control data based on an operating position of a pedal in a musical instrument, comprising:

a pedal configured to be displaceable in response to user's operation;

a driven member configured to be displaceable in interlocked relation to displacement of said pedal;

a control member configured to vary in its position relative to a sounding member, in response to displacement of the driven member, to thereby control the sounding member;

a drive section configured to drive said driven member; and a sensor configured to detect a position of said driven member, wherein said method comprises:

a step of acquiring, from a first database storing therein correspondency relationship between positions of the pedal and positions of the driven member, a position of the pedal corresponding to a position of the driven member detected by the sensor; and a step of acquiring, from a second database storing therein correspondency relationship between positions of the pedal and control values, a control value corresponding to the acquired position of the pedal, and outputting the acquired control value as pedal operation information.

10. The method as claimed in claim 9, further comprising:

a step of acquiring, from the second database, a position of the pedal corresponding to an input control value;

a step of acquiring, from a third database storing therein correspondency relationship between the positions of the pedal and positions of the control value, a position of the control member corresponding to the acquired position of the pedal;

a step of acquiring, from a fourth database storing therein correspondency relationship between the positions of the control value and the positions of the driven member, a position of the driven member corresponding to the acquired position of the control member and outputting, as an instructed position, the acquired position of the driven member; and a step of controlling the drive section to position the driven member at the instructed position.

11. The method as claimed in claim 9, wherein the control value output as the pedal operation information is recorded into a recording medium.

12. A method of reproducing operation of a pedal in a musical instrument, comprising:

a pedal configured to be displaceable in response to user's operation;

a driven member configured to be displaceable in interlocked relation to displacement of the pedal;

a control member configured to vary in its position relative to a sounding member, in response to displacement of the driven member, to thereby control the sounding member;

a drive section configured to drive the driven member; and a sensor configured to detect a position of the driven member, wherein said method comprises:

a step of acquiring, from a first database storing therein correspondency relationship between positions of the pedal and control values, a position of the pedal corresponding to an input control value;

a step of acquiring, from a second database storing therein correspondency relationship between the positions of the pedal and positions of the control member, a position of the control member corresponding to the acquired position of the pedal;

a step of acquiring, from a third database storing therein correspondency relationship between the positions of the control member and positions of the driven member, a position of the driven member corresponding to the acquired position of the control member and outputting, as an instructed position, the acquired position of the driven member; and a step of controlling the drive section to position the driven member at the instructed position.

* * * * *